US006990696B2

(12) United States Patent
Stewart et al.

(10) Patent No.: US 6,990,696 B2
(45) Date of Patent: Jan. 31, 2006

(54) SLEEPING STRUCTURE

(75) Inventors: John Stewart, Cornwall (GB); Stephen Alexander Jacklin, Cornwall (GB); Ray Smith, Cornwall (GB)

(73) Assignee: Spin Master Limited, Ontario (CA)

( * ) Notice: Subject to any disclaimer, the term of this patent is extended or adjusted under 35 U.S.C. 154(b) by 0 days.

(21) Appl. No.: 10/753,865

(22) Filed: Jan. 9, 2004

(65) Prior Publication Data

US 2004/0216238 A1 Nov. 4, 2004

Related U.S. Application Data

(63) Continuation-in-part of application No. 10/060,329, filed on Feb. 1, 2002, now Pat. No. 6,799,339.

(30) Foreign Application Priority Data

Feb. 2, 2001 (GB) ..... 0102655

(51) Int. Cl.
*A47G 9/08* (2006.01)

(52) U.S. Cl. ..... 5/413 R; 5/413 AM; 5/419; 5/420; 5/722

(58) Field of Classification Search ..... 5/413 R, 5/413 AM, 417–420, 710, 711, 722, 733
See application file for complete search history.

(56) References Cited

U.S. PATENT DOCUMENTS

| | | | |
|---|---|---|---|
| 867,464 | A | 10/1907 | Abbott |
| 1,324,009 | A | 12/1919 | Hope |
| 1,648,373 | A | 11/1927 | Vilas |
| 1,699,002 | A | 1/1929 | Liebold |
| 1,867,425 | A | 7/1932 | Swetzel |
| 2,015,588 | A | 9/1935 | Brown |
| 2,304,700 | A | 12/1942 | Manville |
| 2,843,181 | A | 7/1958 | Paschen |
| 3,112,956 | A | 12/1963 | Schick et al. |
| 3,253,861 | A | 5/1966 | Howard |
| 3,393,937 | A | 7/1968 | Wehmer |
| 3,420,574 | A | 1/1969 | Smith |
| 3,633,227 | A | 1/1972 | Tegler |
| 3,798,686 | A | 3/1974 | Gaiser |
| 3,808,616 | A | 5/1974 | White |
| 3,818,962 | A | 6/1974 | Muller-Scherak |
| 3,840,919 | A | 10/1974 | Middleton |

(Continued)

FOREIGN PATENT DOCUMENTS

| | | |
|---|---|---|
| BE | 511104 | 5/1952 |

(Continued)

*Primary Examiner*—Michael Trettel
(74) *Attorney, Agent, or Firm*—Pillsbury Winthrop Shaw Pittman, LLP

(57) ABSTRACT

A multi-position sleeping structure includes a sheet material envelope having an opening into a cavity defined therein. An inflatable mattress is received and substantially enclosed within the cavity of the sheet material envelope. A cover portion which, in conjunction with a top surface of the envelope, defines a sleeping area in which a person can lie and be supported by the mattress. The mattress has a plurality of transversely extending hinges that separate the mattress into a first portion, a second portion, and a third portion. The hinges allow the mattress to be moved between at least a substantially flat sleeping position and a seating position. The sheet material envelope has a retaining pouch on a bottom side thereof that is positioned to receive the first portion of the mattress when in the seating position so as to retain the mattress in the seating position.

46 Claims, 19 Drawing Sheets

U.S. PATENT DOCUMENTS

| | | | |
|---|---|---|---|
| 3,860,980 | A | 1/1975 | Ebert |
| 3,877,092 | A | 4/1975 | Gaiser |
| 3,958,274 | A | 5/1976 | Klauber |
| 4,087,874 | A | 5/1978 | Callaway et al. |
| 4,091,482 | A | 5/1978 | Malcolm |
| 4,102,101 | A | 7/1978 | Nielsen et al. |
| 4,232,692 | A | 11/1980 | Atkins |
| 4,317,244 | A | 3/1982 | Balfour-Richie |
| 4,339,835 | A | 7/1982 | Jaffe et al. |
| 4,389,961 | A | 6/1983 | Parish |
| D270,212 | S | 8/1983 | Secon |
| 4,459,714 | A | 7/1984 | Lin |
| 4,518,203 | A | 5/1985 | White |
| 4,531,330 | A | 7/1985 | Phillips |
| 4,575,884 | A | 3/1986 | Jamerson et al. |
| 4,603,444 | A | 8/1986 | Suits |
| 4,604,765 | A | 8/1986 | Schultz |
| 4,605,029 | A | 8/1986 | Russell |
| 4,673,609 | A | 6/1987 | Hill |
| 4,757,832 | A | 7/1988 | Russell |
| 4,774,734 | A | 10/1988 | Mills |
| 4,856,131 | A | 8/1989 | Mills |
| 4,862,533 | A | 9/1989 | Adams, III |
| 4,896,387 | A | 1/1990 | Malcolm et al. |
| 4,905,332 | A | 3/1990 | Wang |
| 4,965,901 | A | 10/1990 | Normand |
| 4,996,733 | A | 3/1991 | Tsai |
| 5,005,235 | A | 4/1991 | Huang |
| 5,005,236 | A | 4/1991 | Hatchinson |
| 5,052,965 | A | 10/1991 | Klapp et al. |
| 5,086,529 | A | 2/1992 | DeGroot |
| 5,090,695 | A | 2/1992 | Ciolino |
| 5,099,530 | A | 3/1992 | Scott |
| 5,172,440 | A | 12/1992 | Ming |
| 5,190,350 | A | 3/1993 | Hwang et al. |
| 5,210,891 | A | 5/1993 | Avital et al. |
| 5,287,571 | A | 2/1994 | Rademacher |
| 5,303,435 | A | 4/1994 | Haar et al. |
| 5,384,923 | A | 1/1995 | Hwang et al. |
| 5,392,477 | A | 2/1995 | Wolter et al. |
| 5,437,126 | A | 8/1995 | Ramiro |
| 5,471,687 | A | 12/1995 | Vierra |
| 5,474,361 | A | 12/1995 | Hwang et al. |
| 5,528,779 | A | 6/1996 | Lee et al. |
| 5,553,339 | A | 9/1996 | Thomas |
| 5,560,056 | A | 10/1996 | Tai |
| 5,609,938 | A | 3/1997 | Shields |
| 5,640,725 | A | 6/1997 | Ando et al. |
| 5,660,197 | A | 8/1997 | Boe et al. |
| 5,669,088 | A | 9/1997 | McNamee |
| 5,669,092 | A | 9/1997 | Lin |
| 5,740,565 | A | 4/1998 | McDade |
| 5,773,110 | A | 6/1998 | Shields |
| 5,785,219 | A | 7/1998 | Kraft |
| 5,830,529 | A | 11/1998 | Ross |
| 5,858,155 | A | 1/1999 | Hill et al. |
| 5,864,908 | A | 2/1999 | Kielman |
| 5,881,405 | A | 3/1999 | Garrigues |
| 5,966,756 | A | 10/1999 | Cartier |
| 5,966,762 | A | 10/1999 | Wu |
| D420,780 | S | 2/2000 | Cox et al. |
| 6,042,186 | A | 3/2000 | Kojic et al. |
| D434,243 | S | 11/2000 | Casto et al. |
| 6,190,486 | B1 | 2/2001 | Switlik |
| 6,223,367 | B1 | 5/2001 | French et al. |
| 6,243,892 | B1 | 6/2001 | Kelling |
| 6,321,400 | B1 | 11/2001 | Gulino |
| 6,367,083 | B1 | 4/2002 | November |
| 6,367,873 | B1 | 4/2002 | Dorner et al. |
| D458,730 | S | 6/2002 | Jeong |
| 6,421,852 | B1 | 7/2002 | Shao |
| 6,463,604 | B1 | 10/2002 | Reveron et al. |
| 6,478,038 | B1 | 11/2002 | LeGette et al. |
| 6,539,565 | B1 | 4/2003 | Trimble |
| 6,543,072 | B2 | 4/2003 | Hsu |
| 6,546,579 | B1 | 4/2003 | Leventhal et al. |
| 6,564,412 | B2 | 5/2003 | Henley et al. |
| 6,568,012 | B2 | 5/2003 | Michaelis et al. |
| 6,588,036 | B1 | 7/2003 | Hort |
| 6,598,248 | B1 | 7/2003 | Ong |
| 6,675,414 | B2 | 1/2004 | Lamke |
| 6,799,339 | B2 * | 10/2004 | Stewart ..... 5/413 AM |
| 2002/0078501 | A1 | 6/2002 | Lamke |
| 2002/0083525 | A1 | 7/2002 | Zheng |
| 2002/0100120 | A1 | 8/2002 | Hsu |
| 2002/0133879 | A1 | 9/2002 | Smith et al. |
| 2002/0152552 | A1 | 10/2002 | Dewert |
| 2002/0157183 | A1 | 10/2002 | Zheng |
| 2002/0174484 | A1 | 11/2002 | Gotfried |
| 2003/0019037 | A1 | 1/2003 | Michaelis et al. |
| 2003/0028972 | A1 | 2/2003 | Michaleis et al. |
| 2003/0168093 | A1 | 9/2003 | Zheng |
| 2003/0204908 | A1 | 11/2003 | Figler |
| 2004/0025929 | A1 | 2/2004 | Turner |

FOREIGN PATENT DOCUMENTS

| | | | |
|---|---|---|---|
| BE | 903360 | | 2/1986 |
| DE | 2362215 | | 12/1973 |
| DE | 3135647 | A1 | 3/1983 |
| DE | 8811253.5 | | 9/1988 |
| DE | 4437633 | A1 | 10/1994 |
| DE | 19830452 | A1 | 7/1998 |
| DE | 20015180 | U1 | 2/2001 |
| EP | 0086336 | A2 | 1/1983 |
| EP | 0748475 | B1 | 11/1994 |
| EP | 0976349 | A1 | 7/1999 |
| EP | 1342868 | A1 | 10/2003 |
| FR | 2305154 | | 11/1976 |
| FR | 2554335 | A1 | 5/1985 |
| FR | 2671274 | A1 | 4/1991 |
| FR | 2682270 | A1 | 5/1992 |
| FR | 2713902 | A1 | 12/1993 |
| GB | 648452 | | 1/1948 |
| GB | 702513 | | 5/1952 |
| GB | 821966 | | 10/1959 |
| GB | 979852 | | 1/1965 |
| GB | 2118096 | A | 2/1983 |
| GB | 2138048 | A | 10/1984 |
| GB | 2165292 | A | 4/1986 |
| GB | 2166343 | A | 5/1986 |
| GB | 2174383 | A | 11/1986 |
| GB | 2177292 | A | 1/1987 |
| GB | 2185681 | A | 7/1987 |
| GB | 2188873 | A | 10/1987 |
| GB | 2290959 | A | 1/1996 |
| IT | 564949 | | 11/1956 |
| JP | 5333723 | | 3/1978 |
| JP | 8-24104 | | 1/1996 |
| WO | WO 94/17266 | | 8/1994 |
| WO | WO 95/31170 | | 11/1995 |
| WO | WO 97/15433 | | 5/1997 |
| WO | WO 97/15453 | | 5/1997 |
| WO | WO 97/25213 | | 7/1997 |
| WO | WO 97/47481 | | 12/1997 |
| WO | WO 98/17480 | | 4/1998 |
| WO | WO 98/43832 | | 10/1998 |

* cited by examiner

SLEEPING STRUCTURE

CROSS-REFERENCE TO RELATED APPLICATIONS

The present application is a Continuation-in-Part of U.S. application of Stewart, Ser. No. 10/060,329 filed on Feb. 1, 2002, now U.S. Pat. No. 6,799,339, and hereby incorporated into the present application by reference, which in turn claims priority to Great Britain Application No. 0102655.8 filed on Feb. 2, 2001.

BACKGROUND OF THE INVENTION

1. Field of the Invention

The invention of this application relates to sleeping means for use in providing a comfortable, portable, sleeping location for a person. In particular, although not necessarily exclusively, the apparatus can be used in camping, or in other locations where a person may temporarily wish to sleep, perhaps if they are visiting other persons who do not have sufficient beds for use by them or for use by a child who is sleeping over at a friend's house. It should therefore be appreciated that the sleeping means can be used in many different environments and can be adopted to different designs to suit the particular environment.

2. Description of Related Art

For temporary sleeping accommodation, the use of sleeping bags, which typically comprise an envelope of material which has free ends along one side which can be zipped or otherwise joined together to allow the person to move into and get out of the envelope, is well known. When the envelope is zipped the person is kept warm. A problem with the sleeping bag however is that while the same may provide the warmth required by the user, if the user is lying on a floor, or an uneven surface, they can be relatively uncomfortable due to the relative hardness and/or unevenness of the surface.

It is also known for people to sleep on an inflatable mattress, with bedding placed on top of the mattress such as sheets, duvets and the like. This can provide added comfort but what typically happens during use is that the bedding moves with respect to the inflatable mattress and this can allow the person to come into direct contact with the plastic mattress material which can be uncomfortable and/or unpleasant for the person, often causing them to wake up. Alternatively, the person can slip off the mattress during sleep. This is a particular problem with children and can make the same unattractive to the child.

SUMMARY OF THE INVENTION

The aim of the present invention is to provide a sleeping means which allows comfort and warmth to be obtained for the person using the same and for the same to be maintained throughout the night as the person sleeps. It is a further aim to allow the sleeping means to be portable and easily stored when not in use. It is a yet further aim to provide added utility to the sleeping means such that other facilities can be provided to the user hence adapting the sleeping means to suit particular requirements and uses such as for example, children's sleepover parties, outdoor camping and the like.

In a first aspect of the invention there is provided sleeping means comprising a sheet material envelope having an opening into a cavity defined therein for the reception of, and substantial enclosure therein, of a deformable mattress characterized in that the sleeping means further includes a cover section which, in conjunction with the top surface of the envelope, defines a sleeping area in which a person can lie and be supported by the mattress and the cover portion is movable between a first position to substantially enclose the person within the sleeping area and a second position to allow the person to get into or out of the sleeping area of the sleeping means.

Typically therefore, the sleeping means has an opening transversely to the length of the sleeping means into a cavity defined by the sheet material envelope for the reception and substantial enclosure therein of the mattress which is typically an inflatable mattress. The mattress is typically inserted into the cavity in a deflated condition whereupon, the same can then he inflated as required for use.

In a preferred embodiment, at least one edge of the cover portion is integrally attached to the sheet material which defines the cavity for the mattress. Typically a further portion of the cover is selectively engagable with the sheet material envelope by any of stud fastenings, loop and hook fastenings, zips or other suitable releasable fastening means so as to allow the cover to be retained in the first position.

In a preferred embodiment the deformable mattress is an inflatable mattress.

Typically when the cover portion is placed over the person in the sleeping area and the portion of the same is selectively engaged in the first position, only one edge remains free from the sheet material envelope the edge being that most closely located to the head end of the sleeping means.

In one embodiment, when sleeping means includes a pillow receiving section which can receive either a pillow which is separate to the mattress or, preferably, a pillow which is formed by a formed part of the inflatable mattress.

In one embodiment, when the sleeping means is not in use, the separate pillow can be removed from the pillow receiving section. The mattress can be deflated and the pillow receiving section can be used as a storage means such that the mattress and the remaining sheet material are moved, typically by rolling up the same, and placed into the pillow receiving section where it is material for storage. In one embodiment the pillow receiving section can be shaped so as to depict a well known character, or animal or other shape. Preferably the character, animal or shape, or material linked to the same, is also depicted at another location on the sleeping means, typically on the cover portion. This embodiment is particularly attractive to the sleeping means for use by children when cartoon or other well known children's characters can be depicted.

In one embodiment, the cover portion includes filling and/or insulating material to add warmth. For example the cover can be provided in the form of a duvet or other warmth giving configuration so as to improve the warmth and comfort to the person in the sleeping area.

The fabric used for the sheet material can be any suitable fabric of a type for a person sleeping.

In a further embodiment of the invention an additional portion of sheet material is provided, the portion typically having at least one edge permanently fixed to the sleeping means and some of the remaining parts selectively engagable with the sheet material. The additional portion when selectively engaged, forms a storage pocket into which the remainder of the sleeping means comprising the sheet material and mattress can be inserted and stored. In one preferred embodiment the additional portion is attached to the underside of the sleeping means such that when the sleeping means is in use it is not normally viewable. Preferably the surface of the additional portion which faces the sheet material of the sleeping means when the sleeping means is in use becomes an outer surface of the sleeping means when moved to a storage condition. Preferably the surface includes an image applied thereto.

Preferably handles are provided such that when the sleeping means is stored, the same can be transported.

Typically the additional portion is selectively engaged to the sheet material via a zip fastener. Typically the additional portion is selectively engaged once the sheet material and mattress have been moved to the storage position.

In a further embodiment of the invention an inflatable surround is provided around part of all of the sheet material so as to prevent the person sleeping in the same from moving or falling off the inflatable mattress and/or to allow further facilities to be provided such as cup holders, book holders, and the like.

In a yet further embodiment of the invention the sleeping means includes an enclosure structure which covers a portion of the sleeping means.

The enclosure typically incorporates a frame over which sheet material can be placed and acts to support and form the enclosure. In one embodiment the enclosure is used as an insect shield to minimize interference from those insects in the environment where the sleeping means is being used.

In one embodiment the frame is formed of a series of inflatable members which can be integral with or separate to the inflatable mattress.

In a further embodiment the frame is formed of a resilient member or members which are biased to an erected condition so as to allow the same to move between a coiled, storage condition and an extended, erected condition.

Preferably the resilient members(s) moves to the extended position automatically upon release and remains in that position until physically coiled.

In a preferred embodiment the inflatable mattress is wholly inflated and deflated via a single valve inlet/outlet. Typically the valve has a diameter of more than 15 mm to ensure rapid inflation or deflation of the inflatable mattress.

Another aspect of the invention relates to a multi-position sleeping structure including a sheet material envelope having an opening into a cavity defined therein. An inflatable mattress is received and substantially enclosed within the cavity of the sheet material envelope. The mattress is inflatable between an inflated in-use condition and a deflated storage condition. A cover portion which, in conjunction with a top surface of the envelope, defines a sleeping area in which a person can lie and be supported by the mattress. The cover portion is movable between a first position to substantially enclose the person within the sleeping area and a second position to allow the person to get into or out of the sleeping area of the sleeping structure. The mattress has a plurality of transversely extending hinges that separate the mattress into a first portion, a second portion, and a third portion. The hinges allow the mattress to be moved between at least (a) a substantially flat sleeping position and (b) a seating position in which the second portion is folded upwardly with respect to the third portion that remains substantially flat, and the first portion is folded downwardly with respect to the second portion such that the first portion is substantially adjacent to the second portion so that the third portion defines a seat base and the first and second portions define a seat back. The sheet material envelope has a retaining pouch on a bottom side thereof that is positioned to receive the first portion of the mattress when in the seating position so as to retain the mattress in the seating position.

BRIEF DESCRIPTION OF THE DRAWINGS

A specific embodiment of the invention is now described with reference to the accompanying drawings, wherein.

DETAILED DESCRIPTION OF ILLUSTRATED EMBODIMENTS

Figure 1:
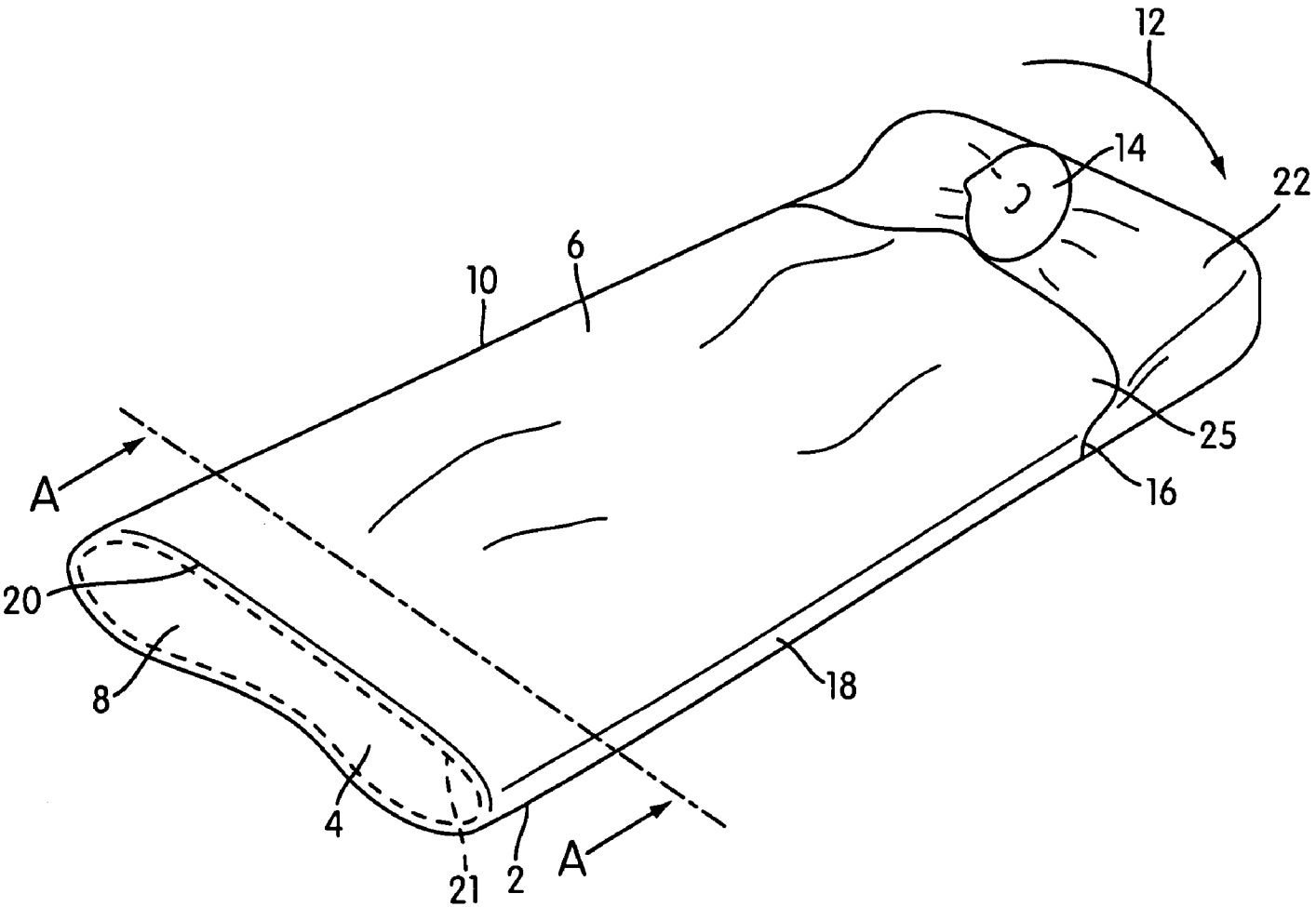
FIG. 1 illustrates a perspective view of the sleeping means in use in accordance with the invention.
Figure 2A:
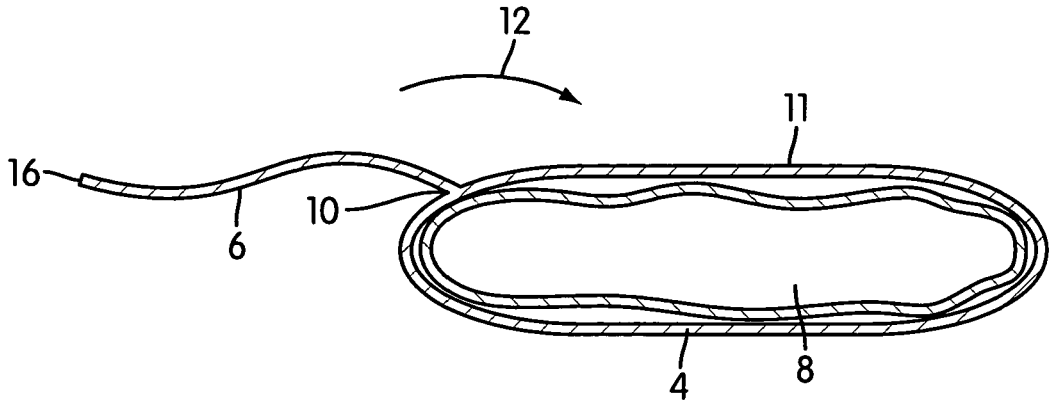
FIGS. 2A and 2B illustrate sectional end views of the sleeping apparatus in second and first conditions respectively, in one embodiment.
Figure 2B:
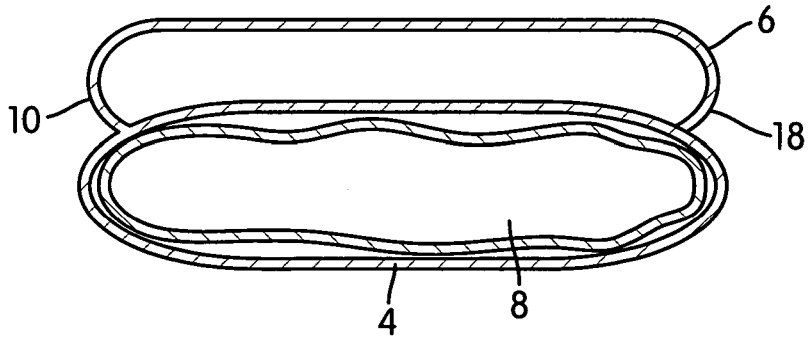

Referring firstly to FIGS. 1, 2A and 2B there is illustrated a sleeping means in accordance with a first embodiment of the invention, the apparatus comprising sheet material 2 which forms an envelope with a cavity 4 and a cover portion 6. The cavity 4 is used to receive an inflatable mattress 8 therein as indicated by broken lines, which extends the length of the cavity and hence the sleeping means.

The cover portion 6 is attached at one edge 10 to the sheet material envelope and together with the top sheet 11 of the envelope 4 defines a sleeping area 5. The free end 16 of the cover portion can be moved as indicated by arrow 12 once a person 14 is in the sleeping area so as to cover themselves as shown. The free edge 16 of the cover can be selectively attached to the edge 18 of the cavity sheet material as shown, in FIG. 2B by zip, hook and loop fastening or other fastening means. The foot end edge 20 of the cover portion may also be attached to the bottom edge 21 of the cavity sheet material 4 thus enclosing the person 14 in the sleeping means with the exception of the aperture 25 at the head end of the sleeping means.

A pillow receiving portion 22 is provided over which the cover 6 does not pass and this portion 22 is formed so as to be higher than the remainder of the mattress to allow the insertion of a pillow or alternatively and preferably, to allow the expansion of the inflatable mattress to form a higher pillow portion 27.

FIGS. 2A and 2B illustrate a cross section along line A—A of FIG. 1 and show the sleeping means with the cover portion in a first, closed condition in FIG. 2B and a second, open condition in FIG. 2A. In FIG. 2A there is shown the cavity 4 with the inflatable mattress 8 in an inflated condition. In this case, the cover 6 is shown in an open position as the person has not yet entered the sleeping area and the cover portion is attached to the sheet material envelope along the edge 10.

Figure 2C:
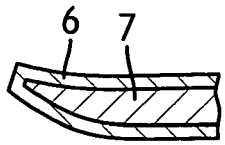
FIG. 2C is a partial cross-sectional view of an embodiment of a cover portion of the sleeping means.

FIG. 2B illustrates the same sleeping means but in this case, the cover portion 6 is in the closed position to enclose a person who wishes to go to sleep in the sleeping area with the cover portion placed over the person to keep the person warm. It is envisaged that it will be particularly preferable for the cover portion 6 to be formed to include or receive some form of warmth giving material such as filling material 7 (see FIG. 2C) so that the cover 6 is effectively a duvet, quilt or the like. In many instances, it may be preferred for all of the sheet material to be provided with pocket to receive warmth giving materials such as feathers etc. to be selectively placed therein and thereby allow the sleeping means to be adapted for use in different environmental conditions and/or to suit personal preferences. Furthermore the layer of material 11 between the mattress and the person in the sleeping area can be padded to make the sleeping in the same more comfortable.

Figure 3:
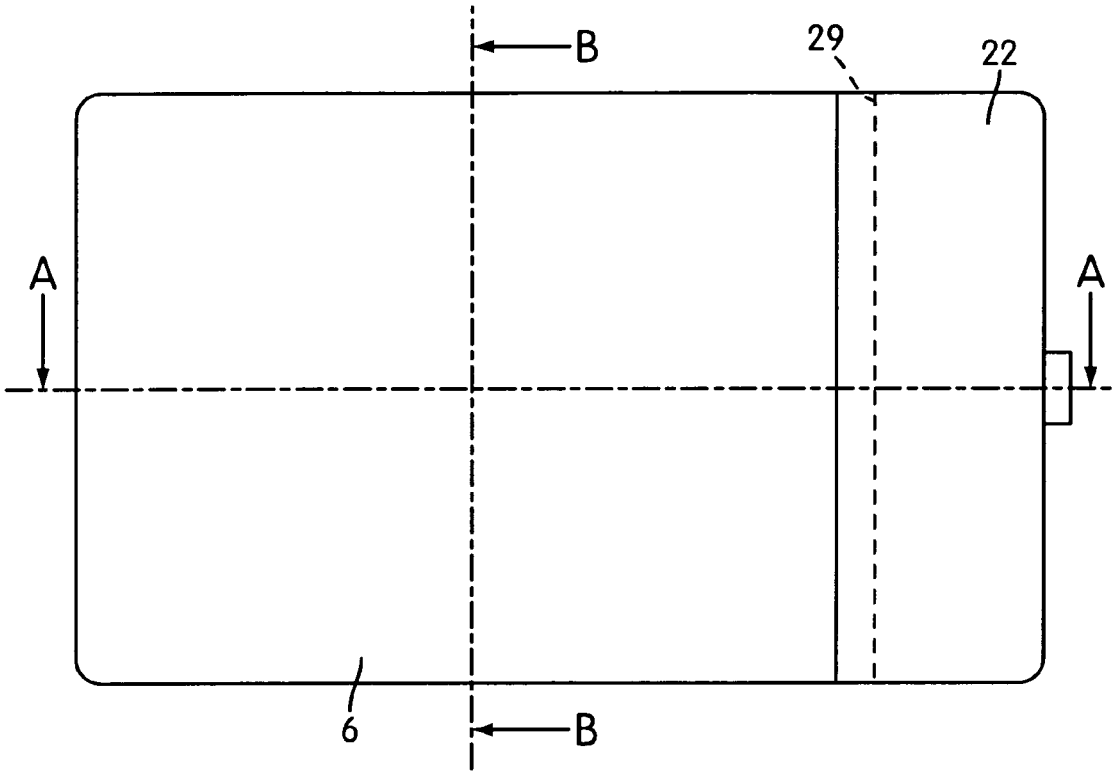
FIG. 3 illustrates a sleeping means according to one embodiment of the invention in plan.
Figure 4A:
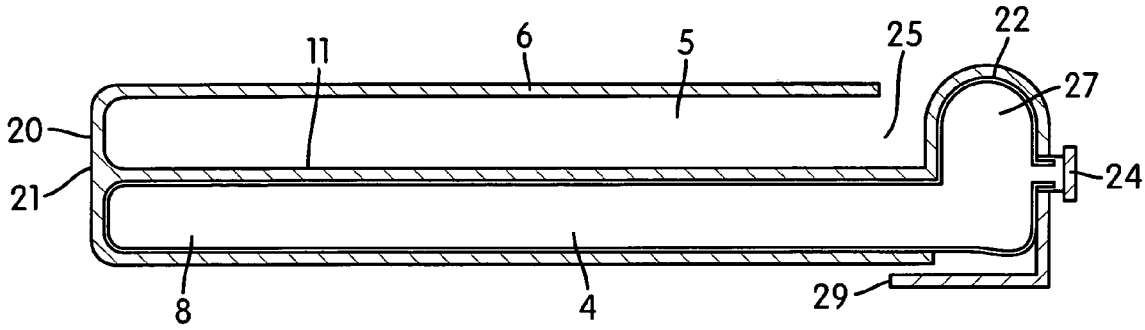
FIGS. 4A and 4B illustrates sectional views of the sleeping means of FIG. 3 along lines A—A and B—B respectively.
Figure 4B:
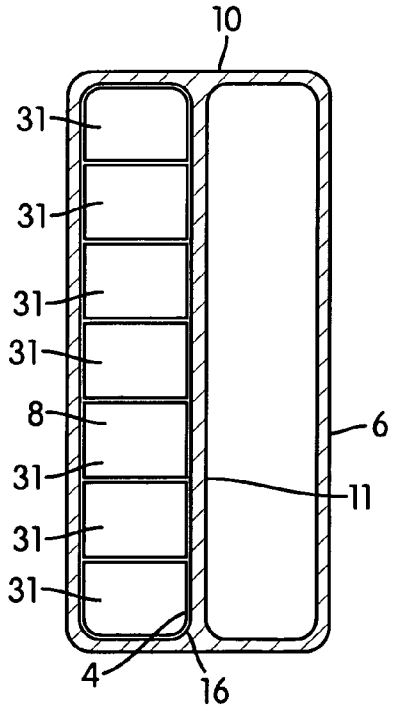

A further embodiment of the sleeping means is illustrated with respect to FIGS. 3, 4A and 4B, using the same reference numbers. In this embodiment the mattress 8 is shown in an inflated condition and includes the pillow portion 27 which fills the pillow receiving portion 22 of the sheet material to form a pillow for the use of the sleeping means.

Thus, in use, the mattress is provided in a deflated condition whereupon the same is inserted into the cavity through an opening 29 and moved along the length of the cavity. Although the mattress can then be removed in a deflated state for washing and the like, it is envisaged that the mattress will normally remain in the cavity, moving between deflated and inflated conditions as required. In an alternative embodiment, not shown, the inflatable mattress may in fact be provided integrally within the envelope so that the same does not need to be inserted into the envelope.

In whichever embodiment, a single valve inlet/outlet 24 provided for the inflation and deflation of the mattress 8. In the embodiments shown the valve is provided at the head end adjacent the pillow. With this invention, the valve and inflation system is designed to allow for full inflation from one inflation valve and by maximizing the size of the aperture so quick inflation and deflation of the mattress can be achieved.

Accordingly, in one embodiment, the internal construction of the inflatable bed is such that there is full communication between all internal sections 31 as shown in FIG. 4B, and also with the integral pillow section 27 and the rest of the mattress. The valve preferably has a large entrance diameter, in excess of 15 mm and most probably around 25 mm. Whilst allowing for swift inflation, either with a manual pump or an electric pump, it also allows for swift deflation, as all the chambers deflate through this large exit orifice. Typically when deflating, the sheet material and mattress are rolled as one towards the opened valve 24 thus allowing the collapsing of the entire bed in seconds.

With the inflatable mattress retained in the cavity defined by the sheet material when stored the subsequent reuse of the sleeping means becomes much simpler thereafter.

Alternatively, the mattress cam of course be simply inserted into the cavity in a deflated or inflated state every time it is required to be used.

The sleeping means as described therefore allows the person to be fully enclosed within the sleeping area of the sleeping means and, importantly, ensures that even when sleeping and moving around in their sleep, the person will not be able to come into direct contact with the inflatable mattress and equally, the inflatable mattress will always stay with the bedding material.

Figure 5:
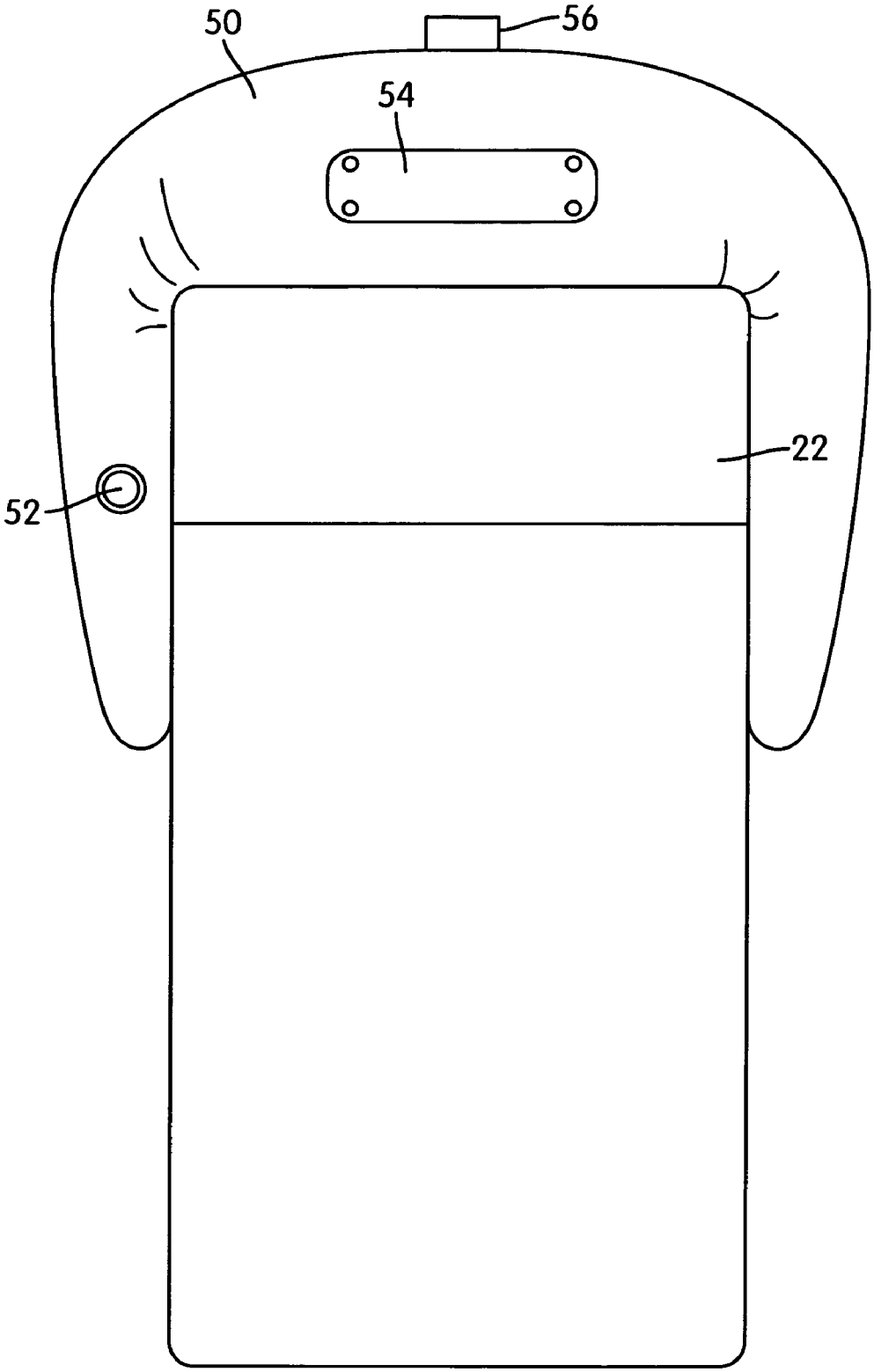
FIG. 5 illustrates a further embodiment of the sleeping means.

FIG. 5 illustrates a further feature of the invention whereby in addition to the sleeping means sheet material and mattress, a surround 50 is provided around the head portion of the sleeping means. This surround has two uses, a first being that it provides support for the persons head should it fall off the raised pillow portion during sleep. Secondly the surround can provide other functions such as a drinks holder cavity 52, book holder 54 and the like. These further functions can be used when the person is lying down or alternatively the person can move to a sitting position using the pillow portion and the surround 50 as a back support and then use the functions as and when required.

In one embodiment the surround is inflatable along with the mattress by the provision of interconnecting ports and via valve 56 or alternatively the surround can be an additional feature which may be selectively attached to the sleeping means by the user.

In one preferred embodiment it is possible to alter the shape of the bed by either changing the shape of the mattress itself (e.g. by having a rounded end, rather than a square end) or by adding 3 dimensional elements 58 to the sheet material that surrounds it.

Figure 6:
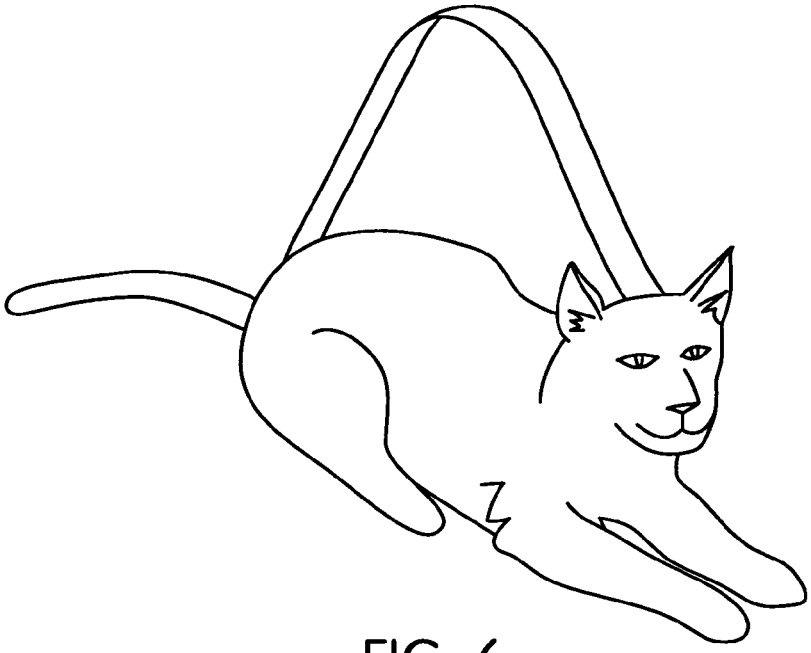
FIG. 6 illustrates an embodiment of the sleeping means in one embodiment of a storage condition.
Figure 7:
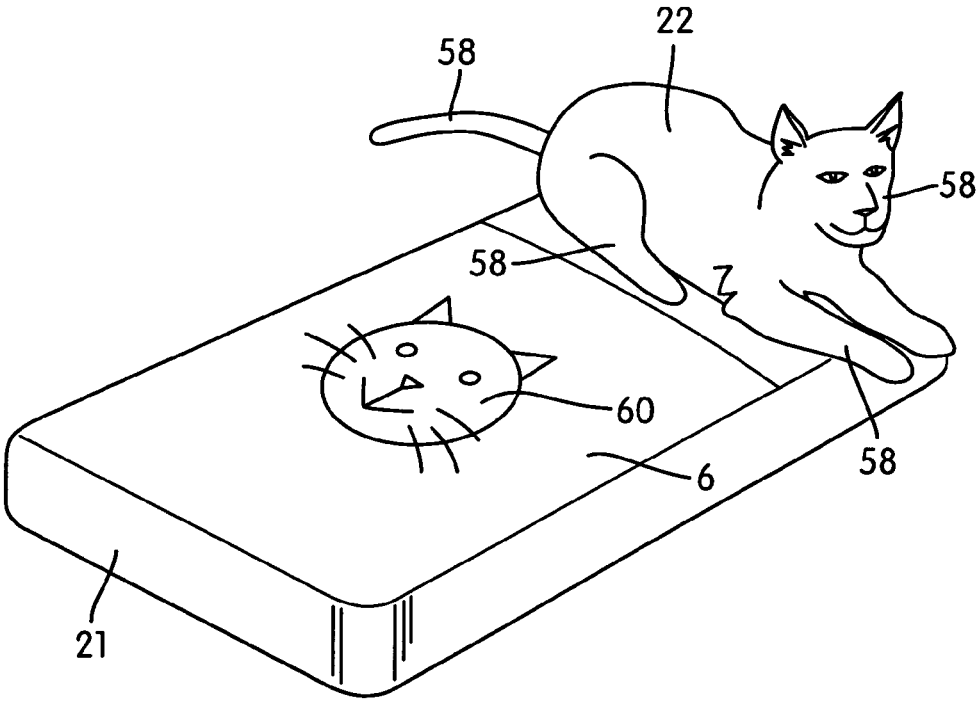
FIG. 7 illustrates the sleeping means of FIG. 6 in an in-use condition.

An example of this is illustrated in FIGS. 6 and 7 where it is shown how elements 58 are added to the pillow receiving portion 22 to represent a cat and a printed or otherwise, applied image 60 on the cover 6 of the sleeping means interacts with these additional 3D elements to further improve the attractiveness of the sleeping means, especially to children.

The storage of the sleeping means when in a deflated condition is also important in that for the sleeping means to be attractive for purchase it is important that the same can be stored easily and compactly. FIGS. 6 and 7 illustrate a first method of storage wherein the soft plush 3 dimensional pillow receiving portion 22 is also usable as a storage bag as shown in FIG. 6. To move from the in use position of FIG. 7 to the storage condition of FIG. 6 the deflated mattress and sheet material are rolled from the foot end 21 to the pillow end. The pillow receiving portion 22 has an opening, not shown, through which the rolled up sleeping means is inserted into the pillow receiving portion. Typically the opening has a zip and the provision of a shoulder strap allows the same to be the easily transportable. To move the same to an in use position the opening is unzipped and the entire mattress with sheet material then rolled out and inflated in the normal way. The empty pillow receiving portion can then be filled with a standard pillow or by the inflation of a suitably formed portion 27 of the mattress, and the resulting soft shape can then become a 3D pillow at the end of the bed as shown in FIG. 7.

Figure 8A:
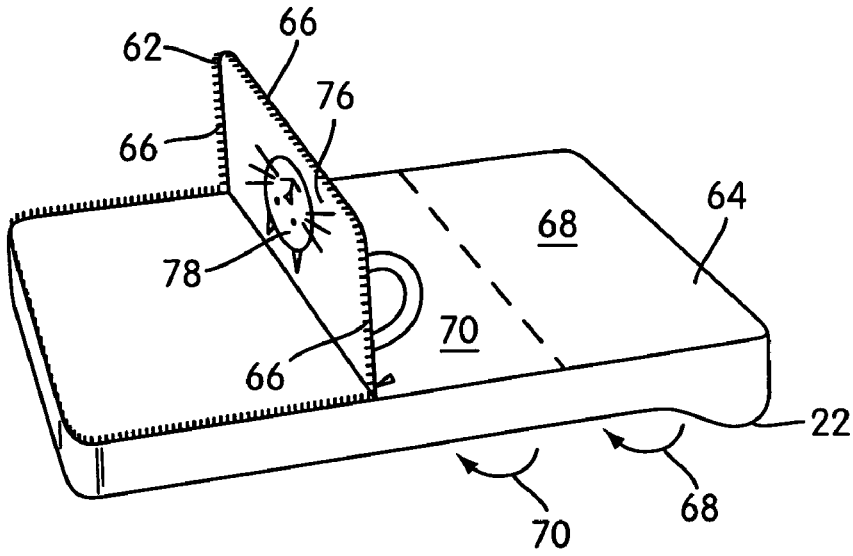
FIGS. 8A–E illustrate the movement of a sleeping means in accordance with the invention between in use and storage conditions in a further embodiment.
Figure 8B:
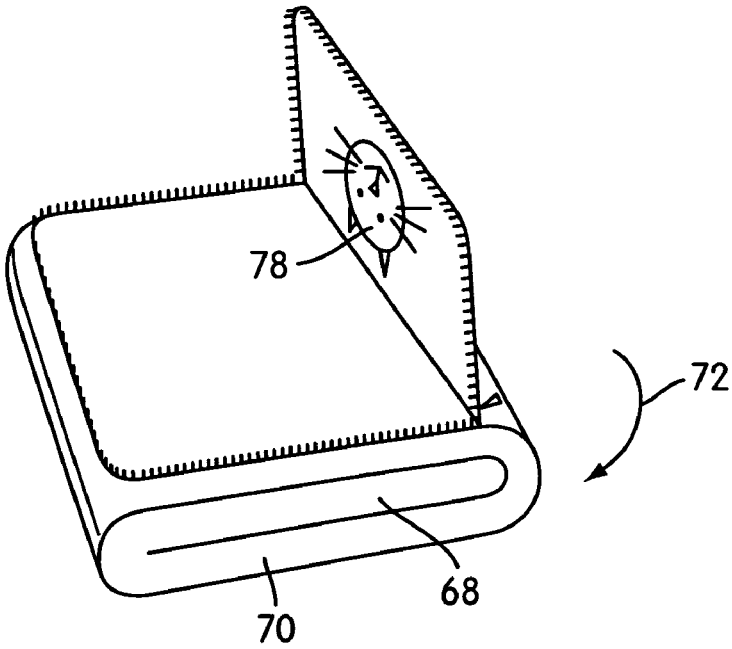

In an alternative embodiment as shown in FIGS. 8A–E it is possible to store the sleeping means by providing an additional portion of sheet material 62 to the underside or base 64 of the sleeping means. The additional portion 62 has a zip or other selective fastening means 66 with a zip on 3 sides that can selectively be used to secure the portion 62 back to the base 64 as is shown. In FIG. 8A the sleeping means is shown in an in use condition with the same upside down and the base 64 uppermost and with the mattress deflated. With the selective engagement means 66 released, the mattress and sheet material are folded towards the additional portion 62 in sections as indicated by 68, 70 in FIGS. 8A and B.

Figure 8C:
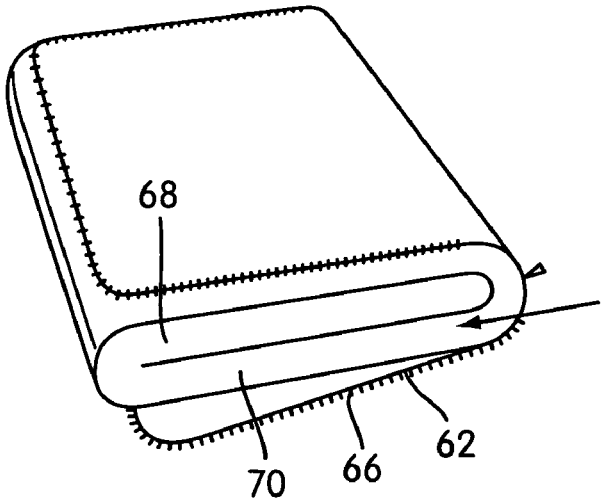

When in this condition the additional portion is folded around the sheet material and mattress portions 68,70 as indicated by arrow 72 to reach the position shown in FIG. 8C.

Figure 8D:
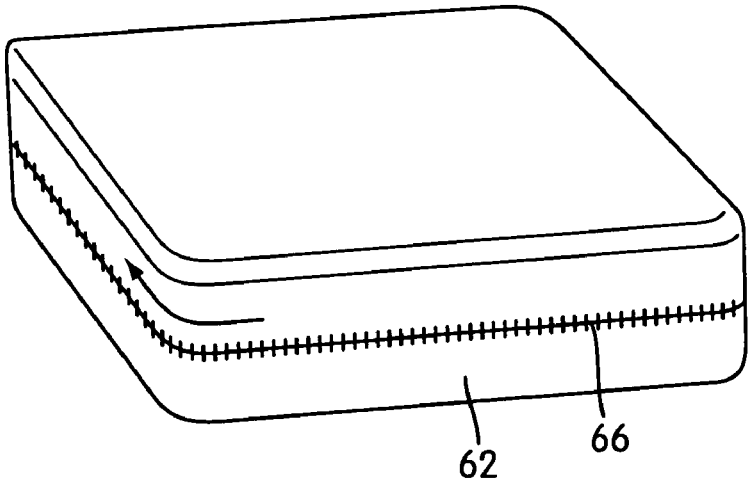
Figure 8E:
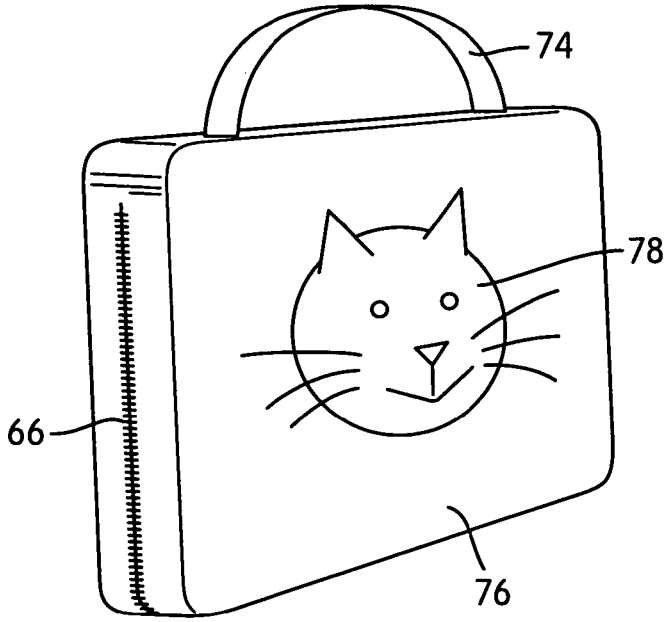

In this position, the zip 66 can be fastened and so the storage bag formed as shown in FIGS. 8D and E. A handle 74 can be provided. In order to add to the attractiveness of the storage bag, the surface 76 of the additional portion can have images 78 formed thereon as when the bag is formed as shown in FIG. 8F. This surface 76 forms an external surface of the bag.

The advantage of this embodiment is that an effective storage bag with a minimal amount of additional material is achieved as the back of the bad becomes part of the bag.

Figure 9:
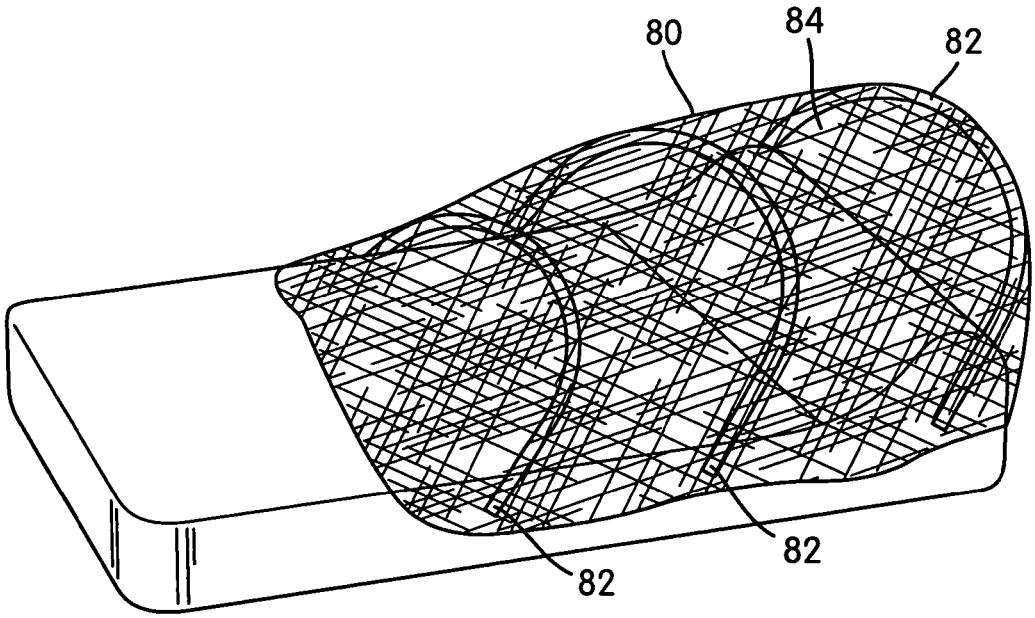
FIG. 9 illustrates a sleeping means with enclosure in accordance with a further embodiment of the invention.

FIG. 9 illustrates a further embodiment of the invention where the sleeping means includes, in addition to the mattress and sheet material, an enclosure 80. The enclosure can be formed from a frame such as an inflatable frame or, as shown, a frame formed from a series of resilient members 82. The enclosure can be provided as a novelty feature for children or, in warm climates, it is advantageous to enclose the sleeping area with some sort of mesh envelope 84 so as to exclude mosquitoes or other insects. With this embodiment of the invention, it is possible to build in a closed hood system that excludes insects from the area around the pillow. This hood system can be simply constructed using fiberglass rods, or by using a combination of fiberglass and spring steel so that the frame is biased to an erected enclosure condition when the sleeping means is moved from the storage condition.

Figure 10:
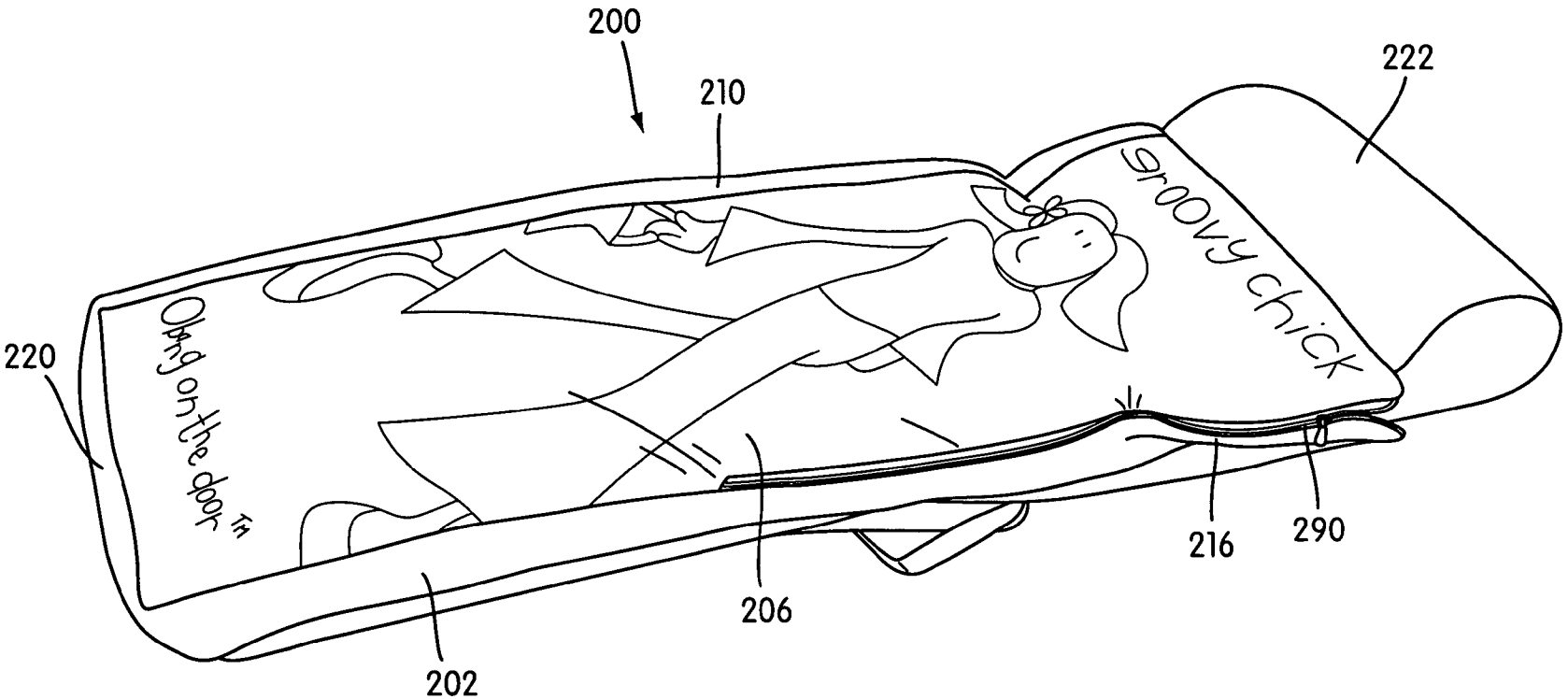
FIG. 10 is a top perspective view of an embodiment of a multi-position sleeping structure, the sleeping structure in a sleeping position.
Figure 11:
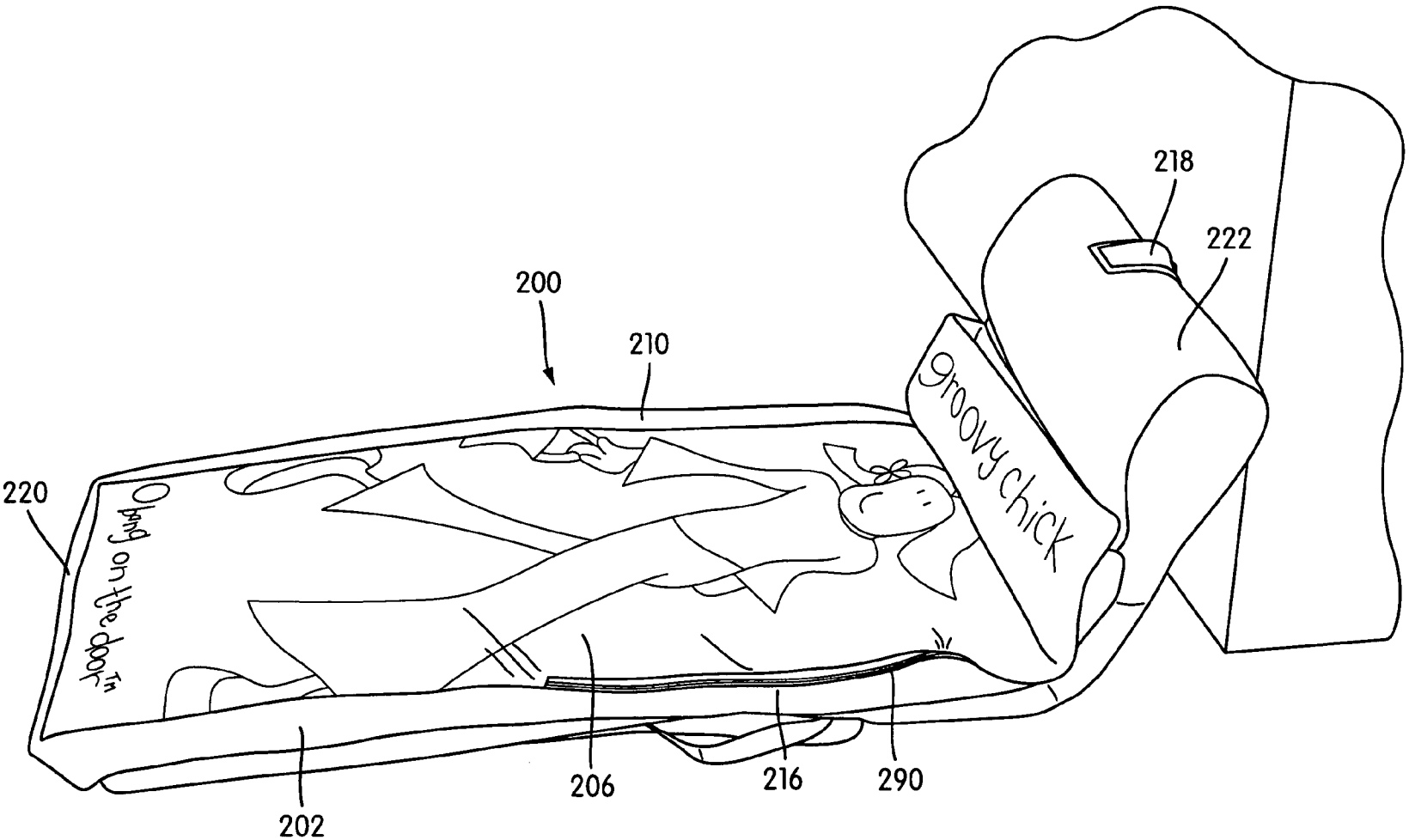
FIG. 11 is a top perspective view of the sleeping structure shown in FIG. 10, the sleeping structure in a propped-up position.
Figure 12:
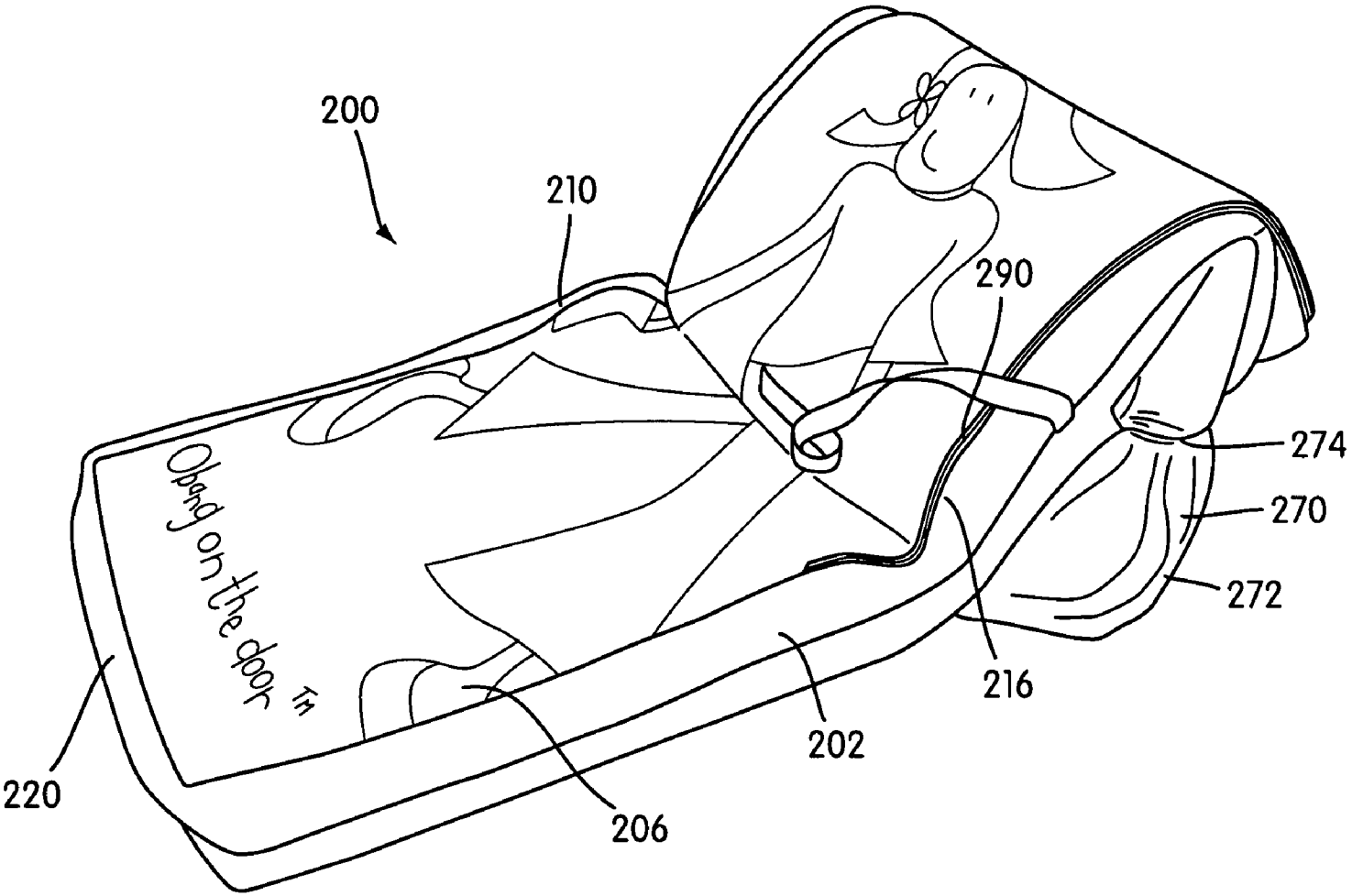
FIG. 12 is a top perspective view of the sleeping structure shown in FIG. 10, the sleeping structure in a seating position.
Figure 19:
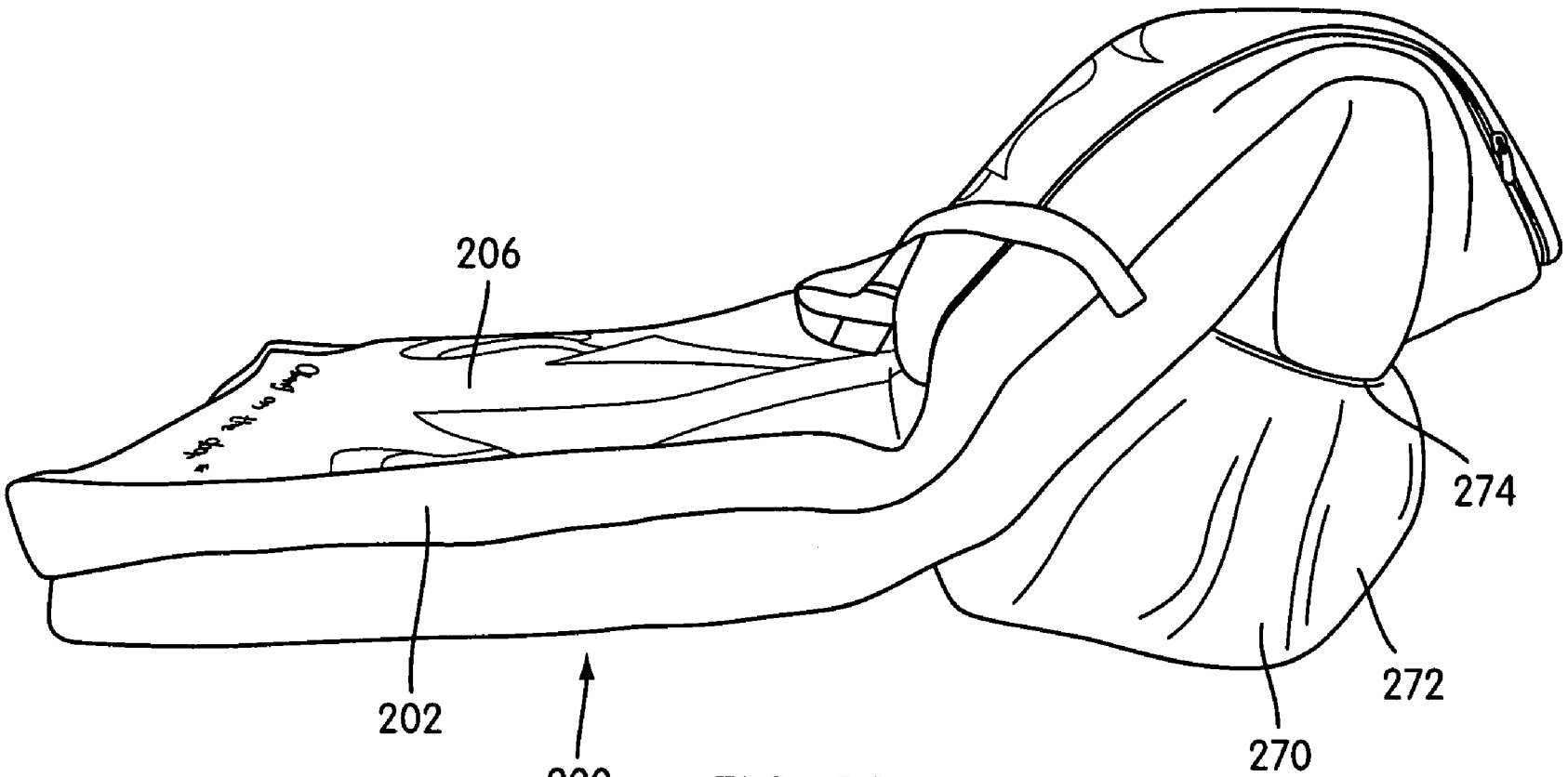
FIG. 19 is a side view of the sleeping structure shown in FIG. 10, the sleeping structure being maintained in a seating position by the retaining pouch.

FIGS. 10–19 illustrate an embodiment of a multi-position sleeping structure 200. In this embodiment, the sleeping structure 200 is configured such that it may be folded or rearranged into a plurality of positions including a sleeping position (as shown in FIG. 10), a propped-up position (as shown in FIG. 11), and a seating or lounger position (as shown in FIGS. 12 and 19). This configuration of the sleeping structure 200 allows the user to assume multiple resting positions on the sleeping structure 200, as will be further discussed below.

Similar to the sleeping means described above, the sleeping structure 200 includes a sheet material envelope 202 having an opening into a cavity defined therein, as best shown in FIGS. 10–12 and 19. The cavity is used to receive and substantially enclose an inflatable mattress 208 (see FIGS. 13–16) therein which extends the length of the cavity.

A cover portion 206 which, in conjunction with the top surface of the envelope 202, defines a sleeping area in which a person can lie and be supported by the mattress 208 within the envelope 202. The cover portion 206 is movable between a first position to substantially enclose the person within the sleeping area and a second position to allow the person to get into or out of the sleeping area of the sleeping structure 200. The top surface of the envelope 202 and the cover portion 206 may each include a filling material to insulate the sleeping area.

In the illustrated embodiment, one side edge 210 and a foot end edge 220 of the cover portion 206 is attached to the sheet material envelope 202 and an opposing side edge 216, opposite the one side edge 210, is selectively and releasably attached to the sheet material envelope 202 by a zipper 290 to retain the cover portion 206 in the first position. However, additional zippers may be provided to releasably attach the cover portion 206 to the sheet material envelope 202. Also, any other suitable releasable fastening structure, such as buttons or hook and loop fasteners, may be used to releasably attach the cover portion 206 to the sheet material envelope 202.

The sheet material envelope 202 has formed therein a pillow receiving portion 222 for the acceptance of a pillow portion 227 provided on the mattress 208.

In the illustrated embodiment, the cover portion 206 includes an image thereon. Specifically, the cover portion 206 includes a cartoonic picture of a "groovy chick." However, the cover portion 206 may include any other suitable image of a character, animal or shape, for example, or may be unadorned.

Also, the pillow receiving portion 222 may be provided with at least one three-dimensional element attached thereto to depict a character, animal or shape that may be associated with the character, animal or shape depicted by the cover portion 206.

The mattress 208 is inflatable between an inflated in-use condition and a deflated storage condition. As shown in FIGS. 13–16, the mattress 208 includes the pillow portion 227 which is inflatable as part of the mattress 208 and the sheet material envelope 202 has formed therein the pillow receiving portion 222 for the acceptance of the pillow portion 227 of the mattress 208.

The mattress 208 includes a series of side by side inflatable sections 231 and, at one end thereof, the pillow portion 227. The longitudinal side walls of the side by side inflatable sections 231 run perpendicularly to the longitudinal side walls of the pillow portion 227.

The side by side inflatable sections 231 and the pillow portion 227 are interconnected to allow the passage of air for inflation and deflation via a valve 224. When inflated, the height of the pillow portion 227 is greater than the height of a remainder of the mattress 208. In the illustrated embodiment, the mattress 208 has a single valve 224. However, additional valves may be provided for inflation and deflation of the mattress 208.

In the illustrated embodiment, the valve 224 is located on the pillow portion 227 of the mattress 208. Also, the valve 224 extends through a flap opening 218 provided in the pillow receiving portion 222 of the sheet material envelope 202. This arrangement allows the sheet material envelope 202 and mattress 208 to be rolled as one towards the opened valve 224 thus allowing rapid collapse of the entire sleeping structure 200.

Also, the inflatable mattress 208 has a pair of transversely extending hinges 250, 252 that separate the mattress 208 into a first portion 254, a second portion 256, and third portion 258. The first portion 254 includes the pillow portion 227. The hinges 250, 252 allow the mattress 208 and hence the sleeping structure 200 to be folded into different positions.

In the illustrated embodiment, the hinges 250, 252 on the mattress 208 are pinch welded hinges, i.e., top and bottom surfaces of the mattress are welded together. The hinges 250, 252 each have "weld gaps" along the hinge that establish fluid communication between the various mattress portions and allow the passage of air throughout the whole mattress 208, thus allowing the mattress 208 to inflate and deflate through a single valve 224.

The hinge 250 is a wider hinge than the hinge 252 (e.g., see FIG. 14), which enables the first portion 254 to fold back and substantially adjacent to the second portion 256.

Figure 13:
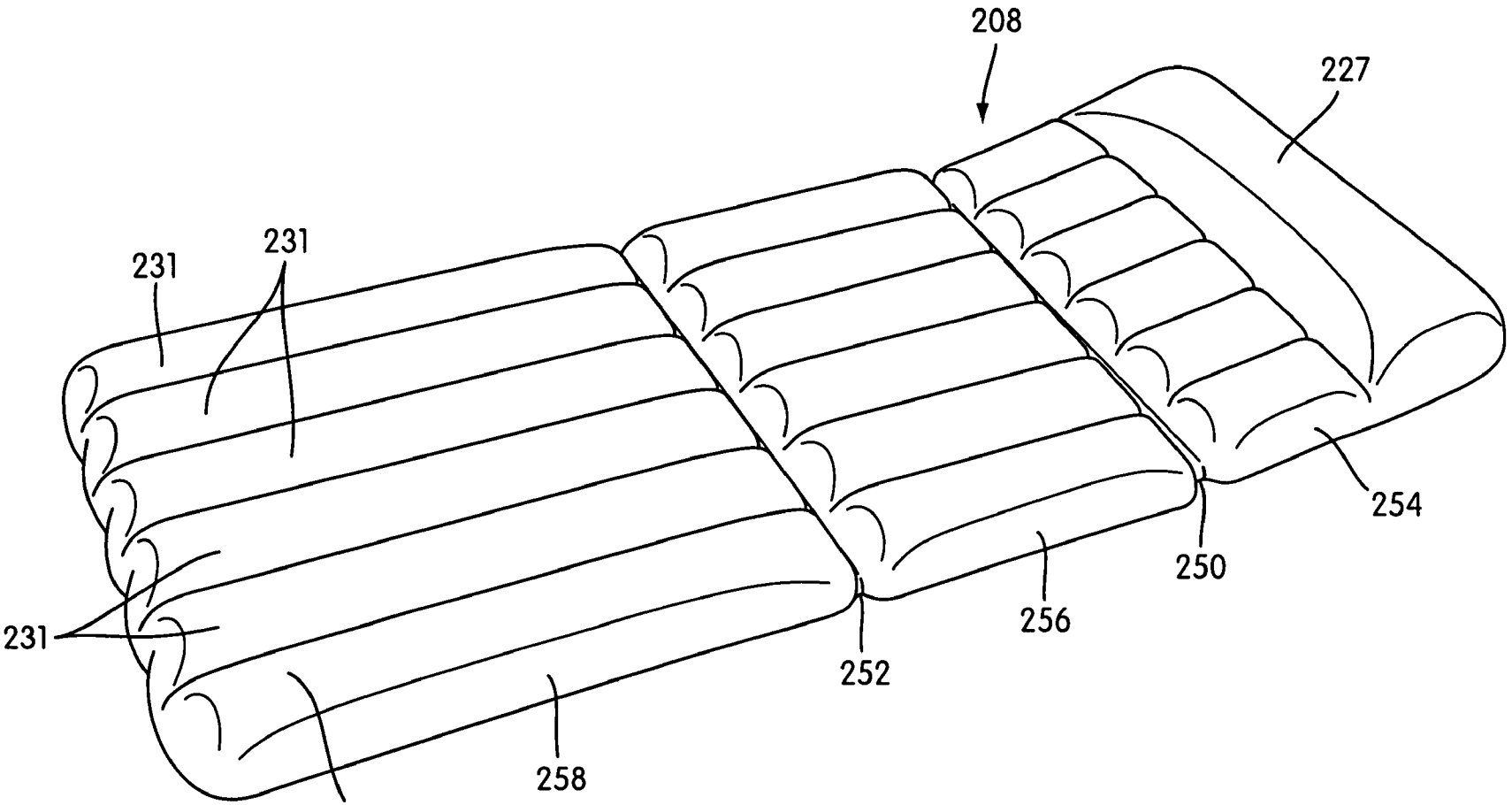
FIG. 13 is a perspective view of an inflatable mattress of the sleeping structure shown in FIG. 10, the inflatable mattress in a sleeping position.
Figure 14:
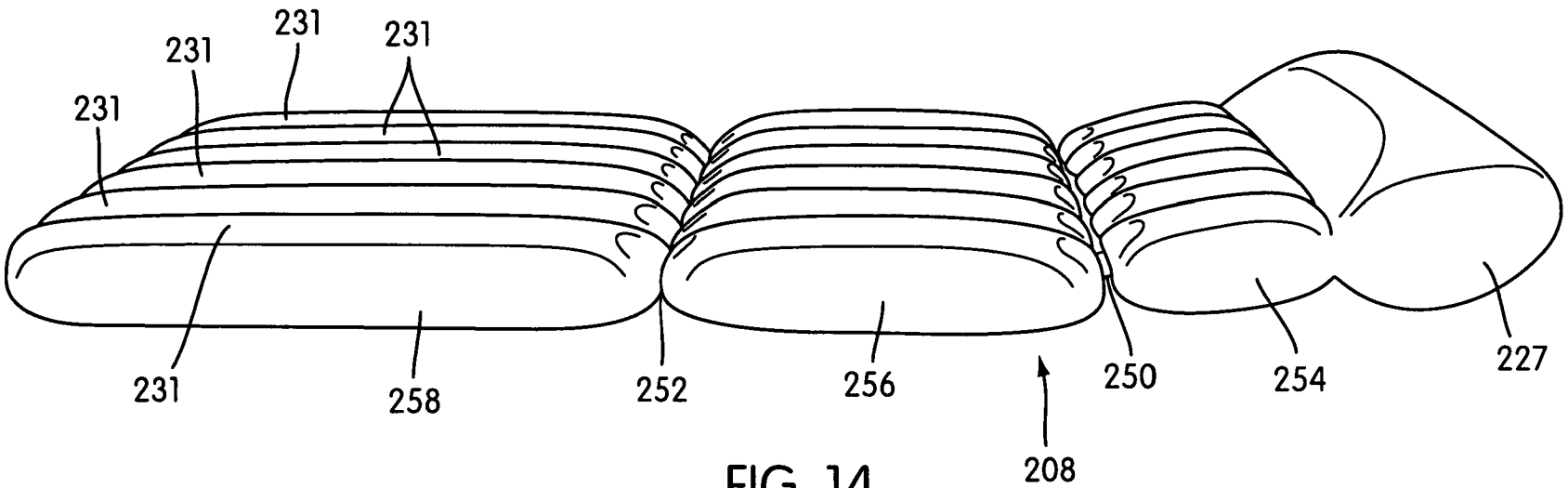
FIG. 14 is a side view of the inflatable mattress shown in FIG. 13, the inflatable mattress in a sleeping position.
Figure 15:
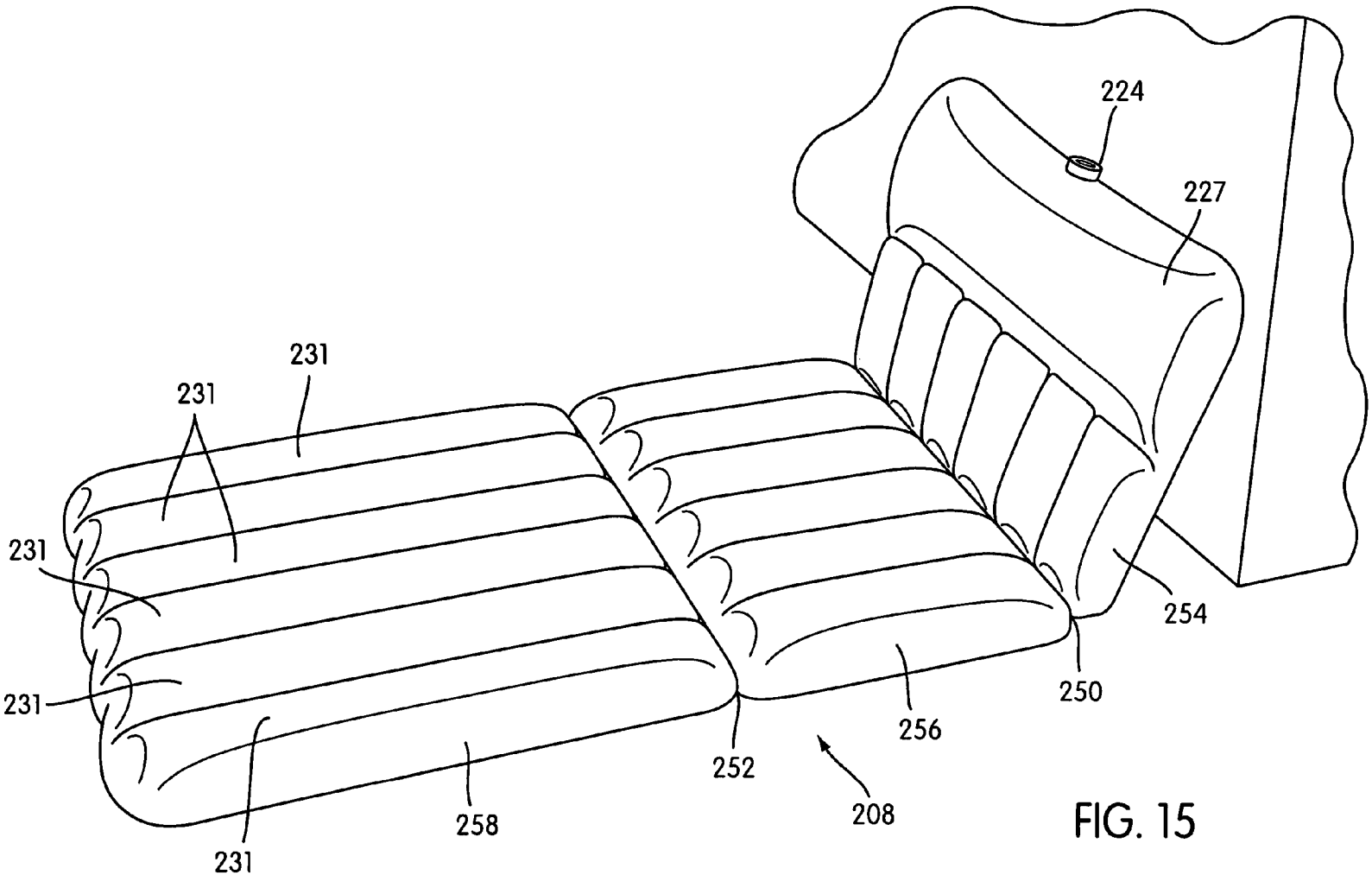
FIG. 15 is a perspective view of the inflatable mattress shown in FIG. 13, the inflatable mattress in a propped-up position.
Figure 16:
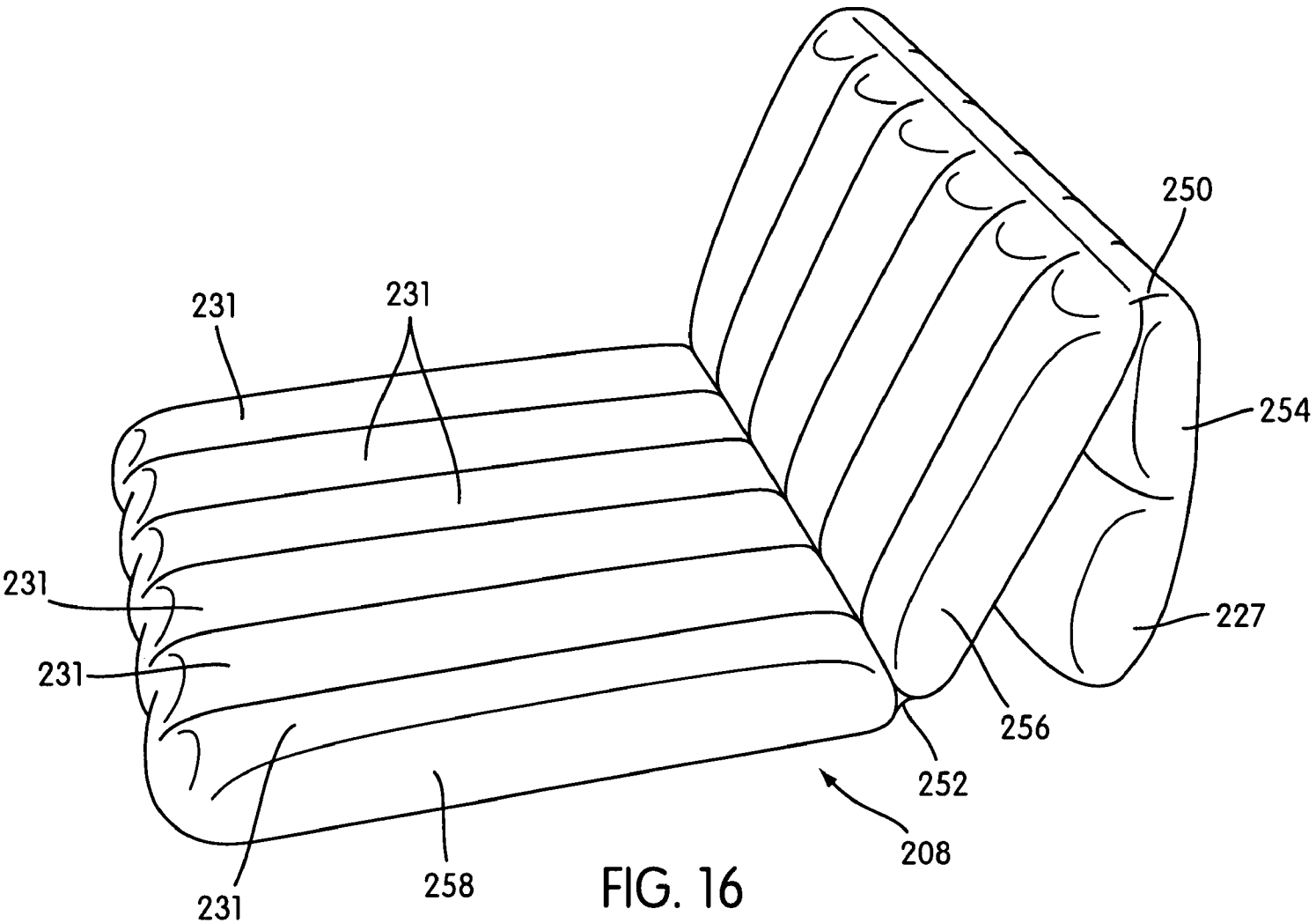
FIG. 16 is a perspective view of the inflatable mattress shown in FIG. 13, the inflatable mattress being held in a seating position.
Figure 17:
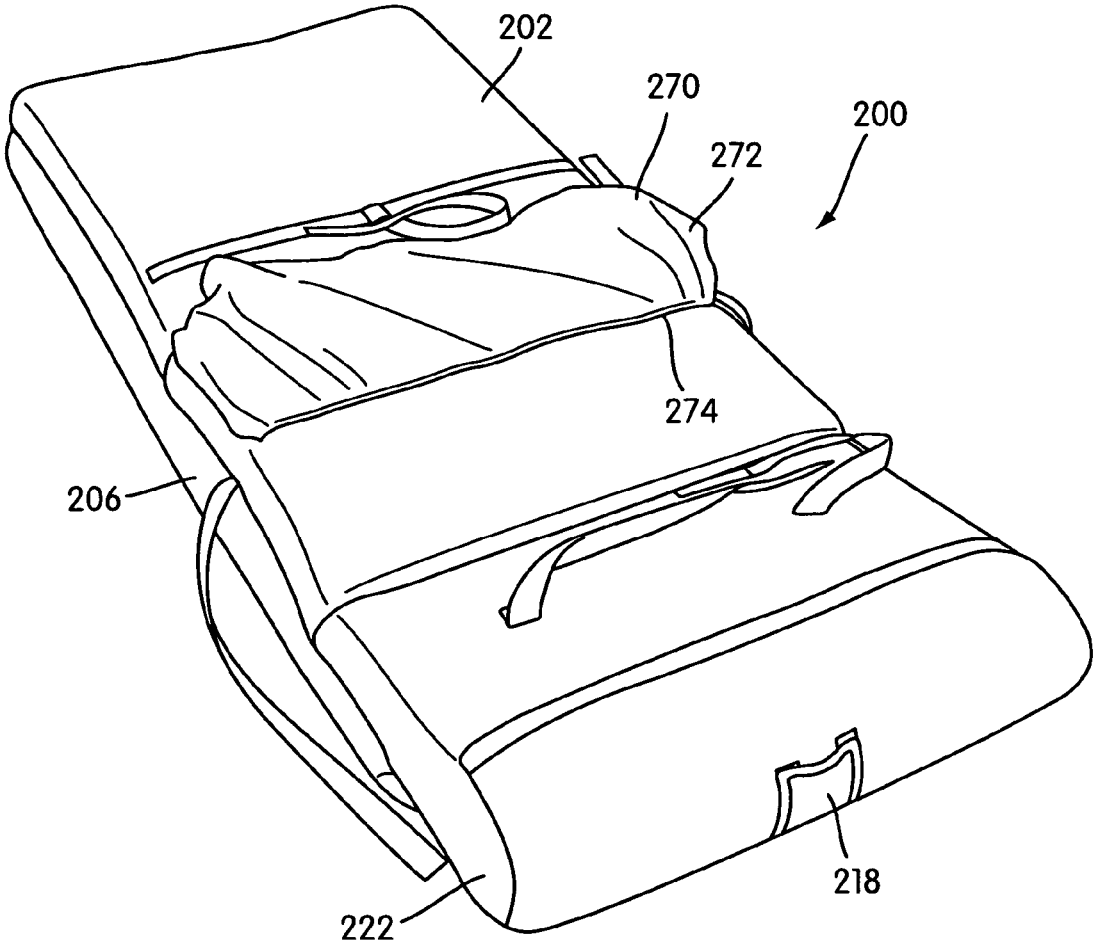
FIG. 17 is a bottom perspective view of the sleeping structure shown in FIG. 10 illustrating a retaining pouch of the sleeping structure.
Figure 18:
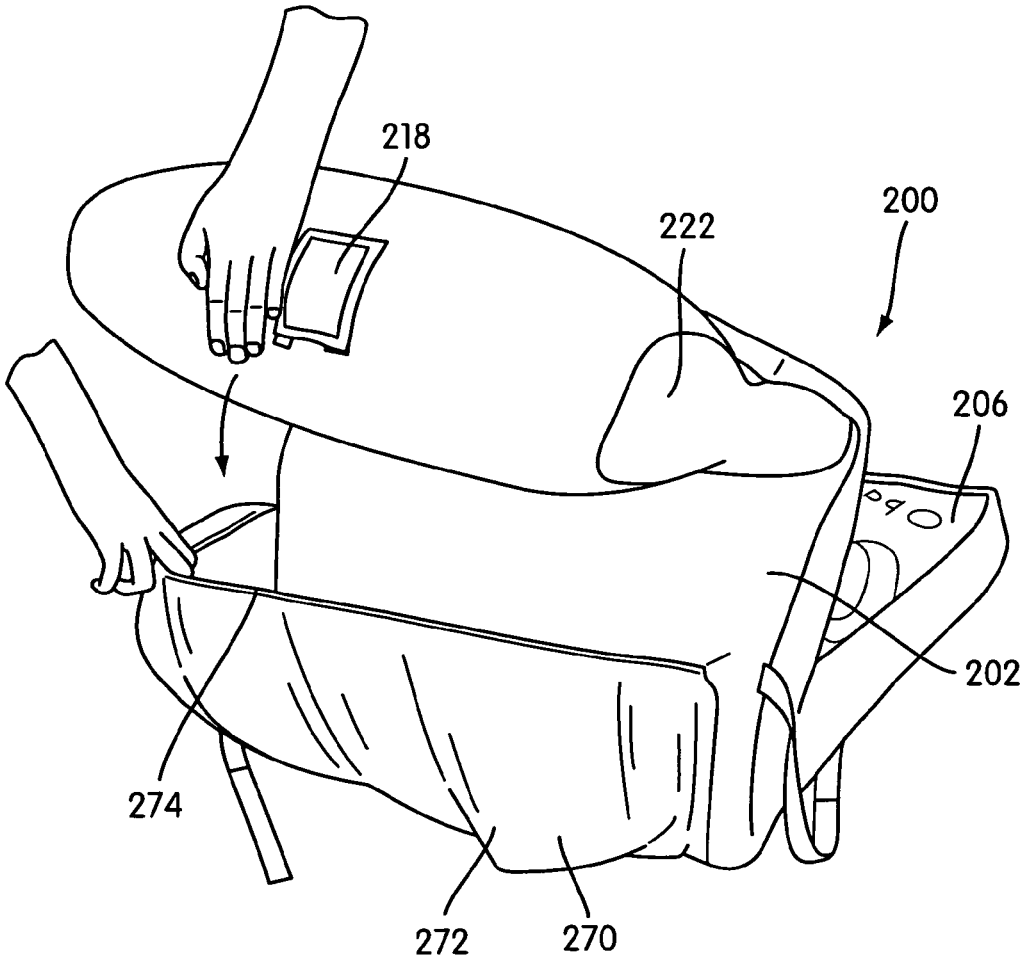
FIG. 18 is a perspective view of the sleeping structure shown in FIG. 10, the sleeping structure being folded into a seating position.

Specifically, FIGS. 13–16 illustrate the inflatable mattress 208 removed from the sheet material envelope 202. FIGS. 13 and 14 illustrate the inflatable mattress 208 in a substantially flat sleeping position. FIG. 15 illustrates the inflatable mattress 208 in a propped-up position wherein the first portion 254 of the mattress 208 is folded upwardly with respect to the second and third portions 256, 258 that remain substantially flat. FIG. 16 illustrates the inflatable mattress 208 in a seating or lounger position wherein the second portion 256 is folded upwardly with respect to the third portion 258 that remains substantially flat, and the first portion 254 is folded downwardly with respect to the second portion 256 such that it is substantially adjacent to the second portion 256. In this seating position, the third portion 258 defines a seat base, and first and second portions 254, 256 define a seat back.

It is contemplated that the mattress 208 may include more than three portions. For example, a fourth portion may be added to the free end of the third portion 258. The fourth portion may be folded under the third portion 258 when in the seating position to add additional padding to the seat base.

As shown in FIGS. 12 and 17–19, the bottom side of the sheet material envelope 202 includes a retaining pouch 270 secured thereto. The retaining pouch 270 allows the sleeping structure 200 to retain its seating or lounger position. That is, the inflatable mattress 208 should be positioned within the sheet material envelope 202 when in at least the seating or lounger position so that the retaining pocket 270 can retain the mattress 208 in its seating position.

The retaining pouch 270 includes a pouch portion 272 that is secured to the bottom side of the sheet material envelope 202. The edge 274 of the pouch portion 272 near the open end thereof is resiliently biased into the sheet material envelope 202. In the illustrated embodiment, the edge 274 has a sewn-in elastic band that resiliently biases the edge 274 inwardly.

The retaining pouch 270 is used to hold the inflated first portion 254 in the seating position. The resiliently biased edge 274 on the retaining pouch 270 facilitates maintaining the first portion 254 within the retaining pouch 270. Also, the resiliently biased edge 274 helps to pull the retaining pouch 270 flush to the bottom side of the sheet material envelope 202 when not in use to hold the sleeping structure in a seating position.

FIGS. 10–12 and 19 illustrate the sleeping structure 200 in the sleeping, propped-up, and seating positions. Specifically, FIG. 10 illustrates the sleeping structure 200 in a substantially flat sleeping position to allow the user to assume a sleeping position thereon. FIG. 11 illustrates the sleeping structure 200 in a propped-up position wherein the first portion 254 of the mattress 208 is folded upwardly with respect to the second and third portions 256, 258 that remain substantially flat. In the propped-up position, the first portion 254 may rest against a wall as illustrated to allow the user to assume a resting position with the user's head propped-up by the first portion 254 and pillow portion 227 thereof. FIGS. 12 and 19 illustrate the sleeping structure 200 in a seating or lounger position wherein the second portion 256 of the mattress 208 is folded upwardly with respect to the third portion 258 that remains substantially flat, and the first portion 254 is folded downwardly with respect to the second portion 256 such that it is substantially adjacent to the second portion 256. The first portion 254 is inserted into the retaining pouch 270 to maintain the seating position of the sleeping structure 200. In the seating position, the user may assume a seating position on the sleeping structure 200 with the user's back supported by the first and second portions 254, 256 of the mattress 208, within the sheet material envelope 202.

When the sleeping structure 200 is not in use, the pillow receiving portion 222 may be usable as a storage area so that the mattress 208 and remaining sheet material envelope 202 may be moved into the pillow receiving portion 222 for storage therein. Alternatively, the retaining pouch 270 may be suitably sized and positioned such that the mattress 208 and remaining sheet material envelope 202 may be moved into the retaining pouch 270 for storage therein. Additionally, a carrying handle or strap may be secured to the sheet material envelope 202 for carrying purposes.

It can thus be appreciated that embodiments of the present invention have now been fully and effectively accomplished. The foregoing embodiments have been provided to illustrate the structural and functional principles of the present invention, and are not intended to be limiting. To the contrary, the present invention is intended to encompass all modifications, alterations and substitutions within the spirit and scope of the appended claims.

What is claimed is:

1. A multi-position sleeping structure comprising:

a sheet material envelope having an opening into a cavity defined therein;

an inflatable mattress received and substantially enclosed within the cavity of the sheet material envelope, the mattress being inflatable between an inflated in-use condition and a deflated storage condition; and a cover portion which, in conjunction with a top surface of the envelope, defines a sleeping area in which a person can lie and be supported by the mattress, the cover portion being movable between a first position to substantially enclose the person within the sleeping area and a second position to allow the person to get into or out of the sleeping area of the sleeping structure, wherein the mattress has a plurality of transversely extending hinges that separate the mattress into a first portion, a second portion, and a third portion, the hinges allowing the mattress to be moved between at least (a) a substantially flat sleeping position and (b) a seating position in which the second portion is folded upwardly with respect to the third portion that remains substantially flat, and the first portion is folded downwardly with respect to the second portion such that the first portion is substantially adjacent to the second portion so that the third portion defines a seat base and the first and second portions define a seat back, and wherein the sheet material envelope has a retaining pouch on a bottom side thereof that is positioned to receive the first portion of the mattress when in the seating position so as to retain the mattress in the seating position.

2. The multi-position sleeping structure according to claim 1, wherein the hinges allow the mattress to be moved into a propped-up position wherein the first portion of the mattress is folded upwardly with respect to the second and third portions that remain substantially flat.

3. The multi-position sleeping structure according to claim 1, wherein the retaining pouch has a resiliently biased edge that engages the first portion of the mattress within the sheet material envelope so as to retain the mattress in the seating position.

4. The multi-position sleeping structure according to claim 1, wherein each of the hinges have gaps that allow the passage of air through the first, second, and third portions of the mattress for inflation and deflation via a valve.

5. The multi-position sleeping structure according to claim 1, wherein one of the hinges is wider than the other of the hinges.

6. The multi-position sleeping structure according to claim 1, wherein the mattress includes a pillow portion which is inflatable as part of the mattress and the sheet material envelope having formed therein a pillow receiving portion for the acceptance of the pillow portion of the mattress.

7. The multi-position sleeping structure according to claim 6, wherein the mattress includes a series of side by side inflatable sections and, at one end thereof, the pillow portion with longitudinal side walls of the side by side inflatable sections running perpendicularly to longitudinal side walls of the pillow portion, the side by side inflatable sections and the pillow portion being interconnected to allow the passage of air for inflation and deflation via a valve, and when inflated, the height of the pillow portion being greater than the height of a remainder of the mattress.

8. The multi-position sleeping structure according to claim 7, wherein the valve is located on the pillow portion of the mattress and extends through an opening provided in the pillow receiving portion of the sheet material envelope.

9. The multi-position sleeping structure according to claim 6, wherein the cover portion includes an image thereon comprising at least one of a character, animal or shape.

10. The multi-position sleeping structure according to claim 9, wherein the pillow receiving portion is provided with at least one three-dimensional element attached thereto to depict a character, animal or shape that is associated with the character, animal or shape depicted by the cover portion.

11. The multi-position sleeping structure according to claim 1, wherein one side edge and a foot end edge of the cover portion is attached to the sheet material envelope and an opposing side edge, opposite the one side edge, is selectively and releasably attached to the sheet material envelope by a zipper to retain the cover portion in the first position.

12. A multi-position sleeping structure comprising:

a sheet material envelope having an opening into a cavity defined therein;

an inflatable mattress received and substantially enclosed within the cavity of the sheet material envelope, the mattress being inflatable between an inflated in-use condition and a deflated storage condition;

a cover portion which, in conjunction with a top surface of the envelope, defines a sleeping area in which a person can lie and be supported by the mattress, the cover portion being movable between a first position to substantially cover the person within the sleeping area and a second position wherein the person is uncovered, at least one side edge of the cover portion being selectively and releasably attached to the sheet material envelope by a zipper to retain the cover portion in the first position; and a retainer structured to retain the mattress in a seating position, wherein the envelope extends beyond the region wherein the cover portion is selectively and releasably attached to the envelope, so that the envelope provides a head engaging region that is unattached to the cover portion, the head engaging region being positioned to receive a person's head when the person is lying and supported by the mattress, wherein the mattress has a plurality of transversely extending hinges that separate the mattress into a first portion, a second portion, and a third portion, the hinges including a first hinge between the first and second portions and a second hinge between the second and third portions, the hinges allowing the mattress to be moved between at least (a) a substantially horizontal sleeping position, and (b) the seating position in which the first and second portions are folded so that they both have a generally vertical configuration that provides a dual portion back support, and in which the third portion remains generally horizontal to define a single portion seat, and wherein the retainer includes a retaining pouch provided on a bottom side of the sheet material envelope, the retaining pouch being positioned to receive the first portion of the mattress when in the seating position so as to retain the mattress in the seating position.

13. The multi-position sleeping structure according to claim 12, wherein the retaining pouch has a resiliently biased edge that engages the first portion of the mattress within the sheet material envelope so as to retain the mattress in the seating position.

14. The multi-position sleeping structure according to claim 12, wherein the hinges allow the mattress to be moved into a propped-up position wherein the first portion of the mattress is folded upwardly with respect to the second and third portions that remain substantially horizontal.

15. The multi-position sleeping structure according to claim 12, wherein each of the hinges have gaps that allow the passage of air through the first, second, and third portions of the mattress for inflation and deflation via a valve.

16. The multi-position sleeping structure according to claim 12, wherein one of the hinges is wider than the other of the hinges.

17. The multi-position sleeping structure according to claim 12, wherein the mattress includes a pillow portion which is inflatable as part of the mattress and the sheet material envelope having formed therein a pillow receiving portion for the acceptance of the pillow portion of the mattress.

18. The multi-position sleeping structure according to claim 17, wherein the mattress includes a series of side by side inflatable sections and, at one end thereof, the pillow portion with longitudinal side walls of the side by side inflatable sections running perpendicularly to longitudinal side walls of the pillow portion, the side by side inflatable sections and the pillow portion being interconnected to allow the passage of air for inflation and deflation via a valve, and when inflated, the height of the pillow portion being greater than the height of a remainder of the mattress.

19. The multi-position sleeping structure according to claim 18, wherein the valve is located on the pillow portion of the mattress and extends through an opening provided in the pillow receiving portion of the sheet material envelope.

20. The multi-position sleeping structure according to claim 17, wherein the cover portion includes an image thereon comprising at least one of a character, animal or shape.

21. The multi-position sleeping structure according to claim 20, wherein the pillow receiving portion is provided with at least one three-dimensional element attached thereto to depict a character, animal or shape that is associated with the character, animal or shape depicted by the cover portion.

22. The multi-position sleeping structure according to claim 12, wherein the cover portion includes an image thereon comprising at least one of a character, animal or shape.

23. A sleeping structure comprising:

a sheet material envelope having an opening into a cavity defined therein;

a deformable mattress received and substantially enclosed within the cavity of the sheet material envelope; and a cover portion which, in conjunction with the top surface of the envelope, defines a sleeping area in which a person can lie and be supported by the mattress, the cover portion being movable between a first position to substantially enclose the person within the sleeping area and a second position to allow the person to get into or out of the sleeping area of the sleeping structure, wherein the mattress is inflatable between an inflated in-use condition and a deflated storage condition, the sheet material envelope having formed therein a storage area that is smaller in size than the cavity defined by the sheet material envelope, the storage area receiving the mattress and remaining sheet material for storage when said sleeping structure is not in use by a person for sleep therein, and the storage area being selectively and releasably closable to secure the mattress and sheet material stored therein.

24. A sleeping structure according to claim 23, wherein at least one edge of the cover portion is integrally attached to the envelope sheet material which defines the cavity for the mattress.

25. A sleeping structure according to claim 23, wherein part of the cover portion is selectively and releasably attached to the envelope sheet material by at least one of stud fastenings, loop and hook fastenings, zip or other releasable fastening structure, lo retain the cover portion in the said first position.

26. A sleeping structure according to claim 23, wherein the mattress includes a pillow portion which is inflatable as part of the mattress, the storage area being usable as a pillow receiving portion for the acceptance of the pillow portion of the mattress when said sleeping structure is in use for a person to sleep therein.

27. A sleeping structure according to claim 26, wherein the pillow receiving portion is provided with at least one three dimensional shape attached thereto to depict a character, animal or shape.

28. A sleeping structure according to claim 27, wherein the cover portion of the sleeping structure includes an image thereon which is linked to the character, animal or shape depicted by the pillow receiving portion.

29. A sleeping structure according to claim 23, wherein the cover portion of the sleeping structure includes at least one of filling material and insulating material to add warmth to the sleeping area.

30. A sleeping structure according to claim 23, wherein the storage area is formed by an additional portion of sheet material provided with at least one part permanently fixed to the sleeping structure and at least some of the remaining edges of the additional portion selectively engagable with the sheet material.

31. A sleeping structure according to claim 30, wherein the additional portion, when wholly engaged with the sleeping structure forms the storage area into which the remainder of the sleeping structure can be inserted and stored when not in use.

32. A sleeping structure according to claim 30, wherein the additional portion is attached to the underside of the sleeping structure.

33. A sleeping structure according to claim 30, wherein a surface of the additional portion facing the underside of the sleeping structure when in the in use condition forms an outer surface of the sleeping structure when in the storage condition.

34. A sleeping structure according to claim 33, wherein the surface includes an image applied thereto and said image, when the sleeping structure is moved to the storage condition, is externally viewable.

35. A sleeping structure according to claim 23, wherein the sleeping structure includes an enclosure structure over at least a portion of the sleeping structure.

36. A sleeping structure according to claim 35, wherein the enclosure incorporates a frame over which sheet material is placed to form the enclosure.

37. A sleeping structure according to claim 36, wherein the frame is formed of a series of inflatable members which can be selectively inflated to form the enclosure.

38. A sleeping structure according to claim 36, wherein the frame is formed of at least one resilient member that is biased towards an erected condition for the enclosure.

39. A sleeping structure according to claim 23, wherein the deformable mattress is an inflatable mattress and is inflated and deflated via a single valve inlet/outlet.

40. A sleeping structure according to claim 39, wherein the valve inlet/outlet is located at a pillow end of the sleeping structure.

41. A sleeping structure according to claim 23, wherein the mattress includes a series of side by side inflatable sections and, at one end thereof, a pillow portion.

42. A sleeping structure according to claim 41, wherein longitudinal side walls of the side by side inflatable sections run perpendicularly to longitudinal side walls of the pillow portion.

43. A sleeping structure according to claim 41, wherein the side by side inflatable sections and the pillow portion are interconnected to allow the passage of air for inflation and deflation via a single valve.

44. A sleeping structure according to claim 23, wherein the mattress includes a pillow portion which is inflatable as part of the mattress, and when inflated, the height of the pillow portion is greater than the height of the remainder of the mattress.

45. A sleeping structure according to claim 23, wherein the mattress includes a pillow portion which is inflatable as part of the mattress, the sheet material envelope having formed therein a pillow receiving portion for the acceptance of the pillow portion of the mattress, and the mattress is inflated and deflated via at least one inlet/outlet valve, wherein the valve extends through an opening provided in the pillow receiving portion of the sheet material envelope.

46. A sleeping structure comprising:

a sheet material envelope having an opening into a cavity defined therein;

a deformable mattress received and substantially enclosed within the cavity of the sheet material envelope; and a cover portion which, in conjunction with the top surface of the envelope, defines a sleeping area in which a person can lie and be supported by the mattress, the cover portion being movable between a first position to substantially enclose the person within the sleeping area and a second position to allow the person to get into or out of the sleeping area of the sleeping structure, wherein the mattress is inflatable between an inflated in-use condition and a deflated storage condition, the mattress including a pillow portion which is inflatable as part of the mattress and the sheet material envelope having formed therein a pillow receiving portion for the acceptance of the pillow portion of the mattress, and wherein the mattress includes a series of side by side inflatable sections and, at one end thereof, the pillow portion with longitudinal side walls of the side by side inflatable sections running perpendicularly to longitudinal side walls of the pillow portion, the side by side inflatable sections and the pillow portion being interconnected to allow the passage of air for inflation and deflation via a single valve, and when inflated, the height of the pillow portion being greater than the height of a remainder of the mattress.

* * * * *